US007980857B2

(12) United States Patent
Cheris et al.

(10) Patent No.: US 7,980,857 B2
(45) Date of Patent: Jul. 19, 2011

(54) FOLDABLE DRY ERASE BOARD

(75) Inventors: Albert B. Cheris, Winnetka, IL (US); Paul A. Moniuszko, Bartlett, IL (US); Morad Ghassemian, Oak Park, IL (US); Paul C. Bond, Chicago, IL (US); Robert J. Glenn, II, Chicago, IL (US)

(73) Assignee: Tenex Corporation, Northbrook, IL (US)

( * ) Notice: Subject to any disclaimer, the term of this patent is extended or adjusted under 35 U.S.C. 154(b) by 485 days.

(21) Appl. No.: 12/062,059

(22) Filed: Apr. 3, 2008

(65) Prior Publication Data

US 2008/0286744 A1 Nov. 20, 2008

Related U.S. Application Data

(60) Provisional application No. 60/910,596, filed on Apr. 6, 2007, provisional application No. 60/981,346, filed on Oct. 19, 2007.

(51) Int. Cl.
*B43L 1/00* (2006.01)

(52) U.S. Cl. ..... 434/408

(58) Field of Classification Search ..... 434/408–422; 16/221, 232, 252, 277, 280, 304, 373; D19/52
See application file for complete search history.

(56) References Cited

U.S. PATENT DOCUMENTS

| | | | | |
|---|---|---|---|---|
| 369,663 | A | 9/1887 | Swaney | |
| 2,142,547 | A | 1/1939 | Anderson | |
| 2,404,563 | A | 7/1946 | Berliner | |
| 2,559,357 | A * | 7/1951 | Holt, Jr. | 108/35 |
| 2,631,046 | A | 3/1953 | Stephens | |
| 3,202,471 | A | 8/1965 | Wilson | |
| 3,550,291 | A | 12/1970 | Albright | |
| 4,051,609 | A | 10/1977 | Boursaw | |
| 4,108,083 | A | 8/1978 | Espinosa | |
| 4,239,170 | A | 12/1980 | Planebo | |

(Continued)

FOREIGN PATENT DOCUMENTS

WO WO2008/124556 A1 10/2008

(Continued)

OTHER PUBLICATIONS

International Search Report and Written Opinion of the International Searching Authority mailed on Aug. 1, 2008 with regard to PCT/US08/59336.

(Continued)

*Primary Examiner* — Kurt Fernstrom
(74) *Attorney, Agent, or Firm* — Neal, Gerber & Eisenberg LLP

(57) ABSTRACT

This invention relates generally to writing boards, and more particularly to reusable and foldable boards that permit writing to be easily removed. In one embodiment, a writing board comprises a substrate comprising a front panel, a rear panel opposite the front panel, and a plurality of spaced apart ribs connecting the front panel to the rear panel, wherein the front panel and the rear panel are integrally formed with the plurality of ribs. The writing board of this embodiment further includes at least one backslit formed in the rear panel, at least one living hinge formed in the front panel opposite the at least one backslit to form at least one outer panel, and at least one holding mechanism coupled to the at least one outer panel to maintain the outer panel in one of a substantially open, unfolded position or a substantially closed, folded position.

24 Claims, 39 Drawing Sheets

U.S. PATENT DOCUMENTS 4,531,564 A 7/1985 Hanna
4,555,128 A 11/1985 White et al.
4,610,414 A 9/1986 Schuch
4,711,046 A 12/1987 Herrgord
4,759,520 A 7/1988 Levine
4,828,502 A 5/1989 Leahy
4,960,383 A 10/1990 Smith et al.
5,035,626 A 7/1991 Persing
5,099,594 A 3/1992 Reas et al.
5,129,609 A 7/1992 Tobin
5,131,448 A 7/1992 Miller
5,131,849 A 7/1992 Perrero
5,152,490 A 10/1992 Deutsch
5,176,522 A 1/1993 Robertson, Jr.
5,388,689 A 2/1995 Kroop et al.
5,422,155 A 6/1995 Spence, Jr.
5,492,476 A * 2/1996 Ball et al. ..... 434/408
5,515,900 A * 5/1996 West et al. ..... 160/135
5,570,735 A 11/1996 Chu
D377,948 S 2/1997 Pruhs
5,727,952 A 3/1998 Schenck et al.
5,775,919 A 7/1998 Gardner
5,938,449 A 8/1999 Masson et al.
6,007,891 A 12/1999 Davis et al.
6,139,331 A 10/2000 Owen
6,155,325 A 12/2000 Schirer
6,164,976 A 12/2000 Wilson
6,241,528 B1 6/2001 Myers
6,292,830 B1 9/2001 Taylor et al.
6,374,751 B1 4/2002 With
D459,756 S 7/2002 Lio et al.
6,450,401 B1 9/2002 Hirota et al.
6,453,518 B1 9/2002 Adams et al.
6,582,236 B1 6/2003 Dian et al.
6,620,500 B2 9/2003 Sweet et al.
6,647,652 B1 * 11/2003 Seiber et al. ..... 40/606.1
6,648,051 B1 11/2003 Young
6,663,073 B1 12/2003 Church
6,666,424 B2 12/2003 Richardson
6,682,352 B2 1/2004 Lopez
6,751,915 B2 6/2004 Crowley
6,837,715 B2 1/2005 Beno
6,895,704 B2 5/2005 Ives et al.
D507,302 S 7/2005 Chen et al.
D507,812 S 7/2005 Cesaroni et al.
D509,247 S * 9/2005 Nash ..... D19/52
D516,498 S 3/2006 Eskandry
D521,068 S * 5/2006 Newbould ..... D19/52
7,178,778 B2 2/2007 Lee
7,185,694 B2 3/2007 Dunn et al.
7,293,993 B2 11/2007 Fedorov et al.
7,568,915 B1 8/2009 Lavoie
2001/0040207 A1 * 11/2001 Richardson ..... 248/460
2002/0009703 A1 1/2002 Owen
2004/0091849 A1 5/2004 Gallant et al.
2004/0148832 A1 8/2004 Albenda
2004/0251289 A1 12/2004 Chretien et al.
2005/0136390 A1 6/2005 Gallbraith Coates
2005/0236347 A1 10/2005 Cole et al.
2006/0024463 A1 2/2006 Gustafson et al.
2006/0266779 A1 11/2006 Mozer et al.
2007/0071536 A1 3/2007 Rhodes
2008/0248456 A1 10/2008 Cheris et al.

FOREIGN PATENT DOCUMENTS

WO WO2008/124558 A1 10/2008

OTHER PUBLICATIONS

International Search Report and Written Opinion of the International Searching Authority mailed on Aug. 7, 2008 with regard to PCT/US08/59340.
International Preliminary Report issued on Oct. 6, 2009 with regard to International Patent Application No. PCT/US2008/059336.
International Preliminary Report issued on Oct. 13, 2009 with regard to International Patent Application No. PCT/US2008/059340.
Non-Final Office Action issued on Aug. 25, 2010 with respect to U.S. Appl. No. 12/062,009.

* cited by examiner

FOLDABLE DRY ERASE BOARD

CROSS-REFERENCE TO RELATED APPLICATIONS

This application claims priority to U.S. Provisional Patent Application Ser. No. 60/910,596 filed on Apr. 6, 2007, and also to U.S. Provisional Patent Application Ser. No. 60/981,346 filed on Oct. 19, 2007, both of which are incorporated herein by reference in their entirety.

BACKGROUND OF THE INVENTION

This invention relates generally to writing boards, and more particularly to reusable and foldable boards that permit writing to be easily removed.

SUMMARY OF THE INVENTION

In one embodiment of the invention, a writing board comprises a substrate, comprising a front panel, a rear panel opposite the front panel, and a plurality of spaced apart ribs connecting the front panel to the rear panel, wherein the front panel and the rear panel are integrally formed with the plurality of ribs. The writing board of this embodiment further includes at least one backslit formed in the rear panel, at least one living hinge formed in the front panel opposite the at least one backslit to form at least one outer panel, and at least one holding mechanism coupled to the at least one outer panel to maintain the outer panel in one of a substantially open, unfolded position or a substantially closed, folded position.

In this embodiment, the plurality of ribs may be oriented in a widthwise direction, a lengthwise direction, both a widthwise direction and a lengthwise direction, or a diagonal direction of the substrate. The plurality of ribs may extend from a first end of the substrate to a second end of the substrate opposite the first end. The writing board may further include a film affixed to at least one of the front or rear panels of the substrate, the film having a surface adapted to erasably receive writing thereon, wherein the film may be a polyester, a UV cured polyurethane, or a polypropylene.

The at least one holding mechanism of this embodiment may comprise a resilient member, at least one cable connected to at least one end of the resilient member, and at least one anchor connected to the at least one cable and to the at least one outer panel, wherein the at least one holding mechanism may be housed in at least one trim panel removably affixed to a peripheral edge of the substrate.

Alternatively, a portion of the at least one holding mechanism may be housed in at least one flute formed between two adjacent ribs, the front panel, and the rear panel of the substrate. In this configuration, the at least one holding mechanism may further comprise at least one hinge comprising a plurality of flute mounts, wherein the flute mounts may be mounted inside the at least one flute on respective sides of the at least one backslit to secure the at least one hinge to the substrate and to permit articulation of the at least one outer panel.

The at least one holding mechanism of the writing board may exert a force to the at least one outer panel that varies during articulation of the at least one outer panel. The force increases from a first minimum when the at least one outer panel is in the substantially open, unfolded position to a maximum when the at least one outer panel is in a partially articulated position, then decreases to a second minimum when the at least one outer panel is in the substantially closed, folded position.

The writing board of this embodiment may further include a writing instrument holder affixed to the substrate, comprising an eraser mount for detachably receiving an eraser, and at least one clip for detachably receiving at least one writing instrument, wherein the at least one outer panel is configured to avoid interference with the writing instrument holder when the at least one outer panel is articulated to and from the substantially closed, folded position.

In another embodiment of the invention, a writing board comprises a substrate comprising a front panel and a rear panel separated by a spacer, wherein the front panel and the rear panel are integrally formed with the spacer, at least one backslit formed in the rear panel, at least one living hinge formed in the front panel opposite the at least one backslit to form at least one outer panel, and at least one holding mechanism operable to maintain the outer panel in one of a substantially open, unfolded position or a substantially closed, folded position.

The writing board may further include a film affixed to at least one of the front or rear panels of the substrate, the film having a surface adapted to erasably receive writing thereon. The substrate of the writing board may comprise one of corrugated paper, a foam, a metal, or a plastic. The spacer may be formed as a solid, a porous solid, a plurality of spaced apart ribs, a plurality of honeycomb cells, or a plurality of corrugations. The at least one holding mechanism may be housed in at least one trim panel removably affixed to a peripheral edge of the substrate. The at least one holding mechanism may exert a force to the at least one outer panel that increases from a first minimum when the at least one outer panel is in the substantially open, unfolded position to a maximum when the at least one outer panel is in a partially articulated position, then decreases to a second minimum when the at least one outer panel is in the substantially closed, folded position.

In yet another embodiment, a writing board comprises a substrate having a front panel connected to a rear panel by a plurality of ribs, wherein at least one of the front or rear panels comprises a dry erase property, and a plurality of outer panels formed in the substrate, the plurality of outer panels configured to articulate from a substantially open, unfolded position to a substantially closed position and from the substantially closed position to the substantially open, unfolded position, wherein the plurality of outer panels are maintainable in the substantially open, unfolded position or the substantially closed, folded position by a plurality of holding mechanisms coupled to the plurality of outer panels.

The plurality of holding mechanisms may exert a force upon the plurality of outer panels that initially increases when any one of the plurality of outer panels is articulated from a substantially open, unfolded position or a substantially closed, folded position, then decreases when any one of the plurality of outer panels is articulated past a stationary point of inflection. The writing board may further include a writing instrument holder affixed to the substrate, comprising an eraser mount for detachably receiving an eraser, and at least one clip for detachably receiving at least one writing instrument, wherein the at least one outer panel is configured to avoid interference with the writing instrument holder when the at least one outer panel is articulated to and from the substantially closed, folded position. The writing board may further comprise a mount affixed to the rear panel of the substrate to permit detachable affixation of the writing board to a surface, a plurality of backslits formed in the rear panel to permit the plurality of outer panels to articulate, and a plurality of living hinges formed in the front panel opposite the plurality of backslits.

A better understanding of the objects, advantages, features, properties and relationships of the invention will be obtained from the following detailed description and accompanying drawings which set forth illustrative embodiments that are indicative of the various ways in which the principles of the invention may be employed.

BRIEF DESCRIPTION OF THE DRAWINGS

For a better understanding of the invention, reference may be had to preferred embodiments shown in the following drawings in which.

DETAILED DESCRIPTION

Figure 1:
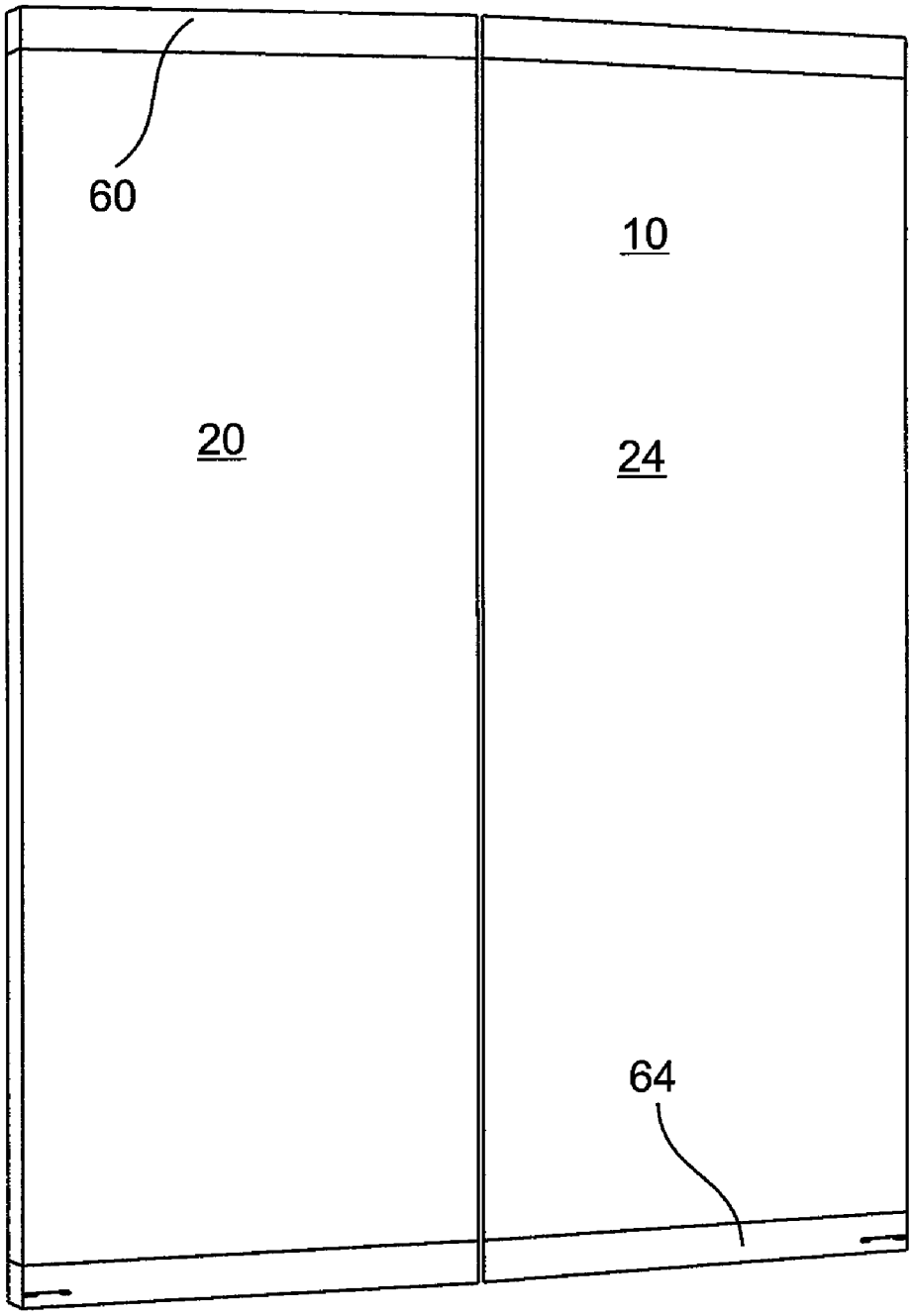
FIG. 1 illustrates a front perspective view of one embodiment of the present invention.

While this invention is susceptible of embodiments in many different forms, there is shown in the drawings and will herein be described in detail, a preferred embodiment of the invention with the understanding that the present disclosure should be considered as an exemplification of the principles of the invention and is not intended to limit the broad aspects of the invention to the embodiments illustrated herein. For the sake of simplicity, like numerals are used to describe identical or substantially identical components where appropriate.

Figure 2:
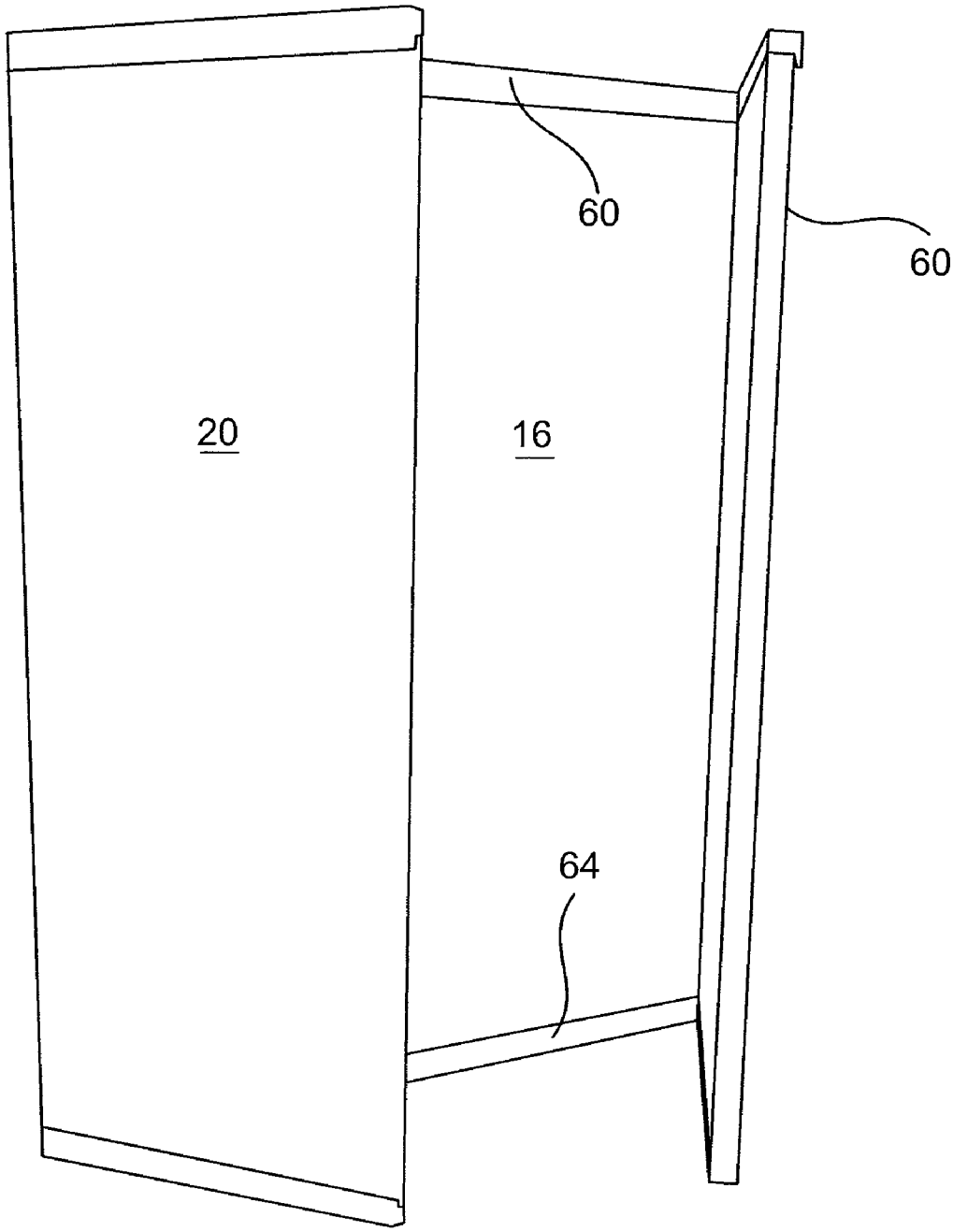
FIG. 2 illustrates a partially articulated left perspective view of the embodiment of FIG. 1.
Figure 3:
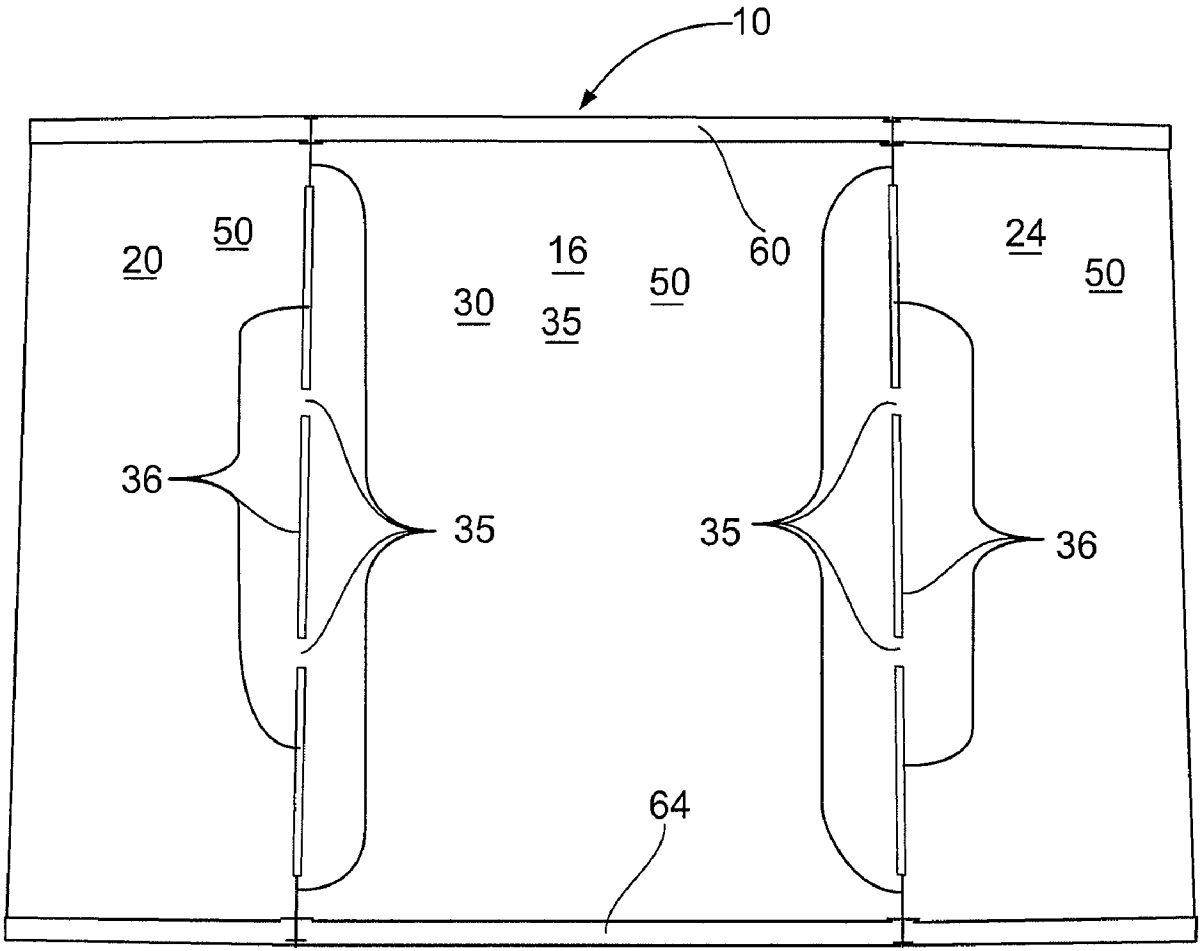
FIG. 3 illustrates a fully articulated front elevational view of the embodiment of FIG. 1 with both side panels in their respective open positions.

Turning now to the figures, wherein like reference numerals refer to like elements, there is illustrated in FIG. 1 foldable dry erase writing board 10 incorporating the improvements of the present invention. As best shown in FIGS. 1-3, writing board 10 includes center panel 16 and left and right side panels 20, 24 connected to center panel 16. Writing board 10 may be fabricated in common sizes, such as 9" W×12" L (closed; 18" W×12" L open), 12" W×16" L (closed; 24"

W×16" L open), 18" W×24" L (closed; 36" W×24" L open), 24" W×36" L (closed; 48" W×36" L open), and 36" W×48" L (closed; 72" W×48" L open), or any other size or shape as may be required by users of the device.

Figure 4:
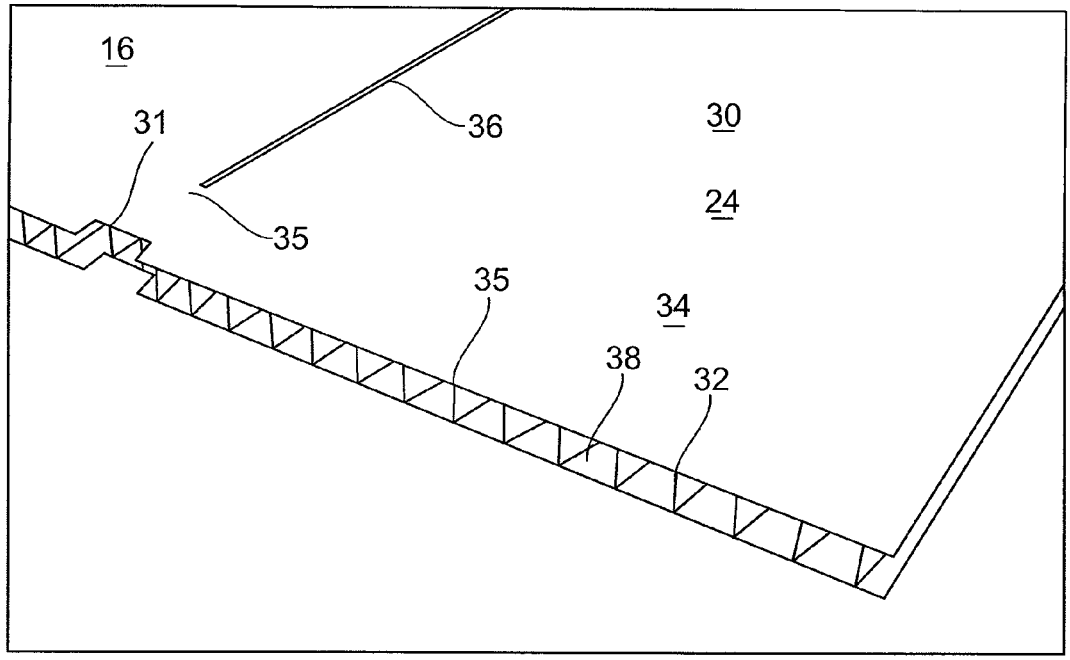
FIG. 4 illustrates a partial bottom right perspective view showing the interior of the embodiment of FIG. 1 without the bottom trim installed and with the right side panel fully open.

As shown in FIGS. 3-4, panels 16, 20, and 24 may include lightweight yet sturdy substrate 30. Substrate 30 may itself have properties conducive for writing thereon to be easily removed. Alternatively, as more fully described below, a film or other surface treatment or coating may be applied to one or more surfaces of substrate 30 for this purpose.

Substrate 30 may comprise any one of a number of materials that are lightweight, strong and inexpensive. For example, substrate 30 may be formed from a plastic, such as polypropylene copolymer, a metal, such as aluminum, or a composite material, or may be formed from other common materials of construction, such corrugated paper or foam core. Substrate 30 may be formed with a solid, corrugated, porous, or hollow structure, such as an I-beam structure, a honeycomb structure, a cellular structure, or any one of a number of other structural forms to provide a lightweight, strong, and inexpensive structure.

Figure 5:
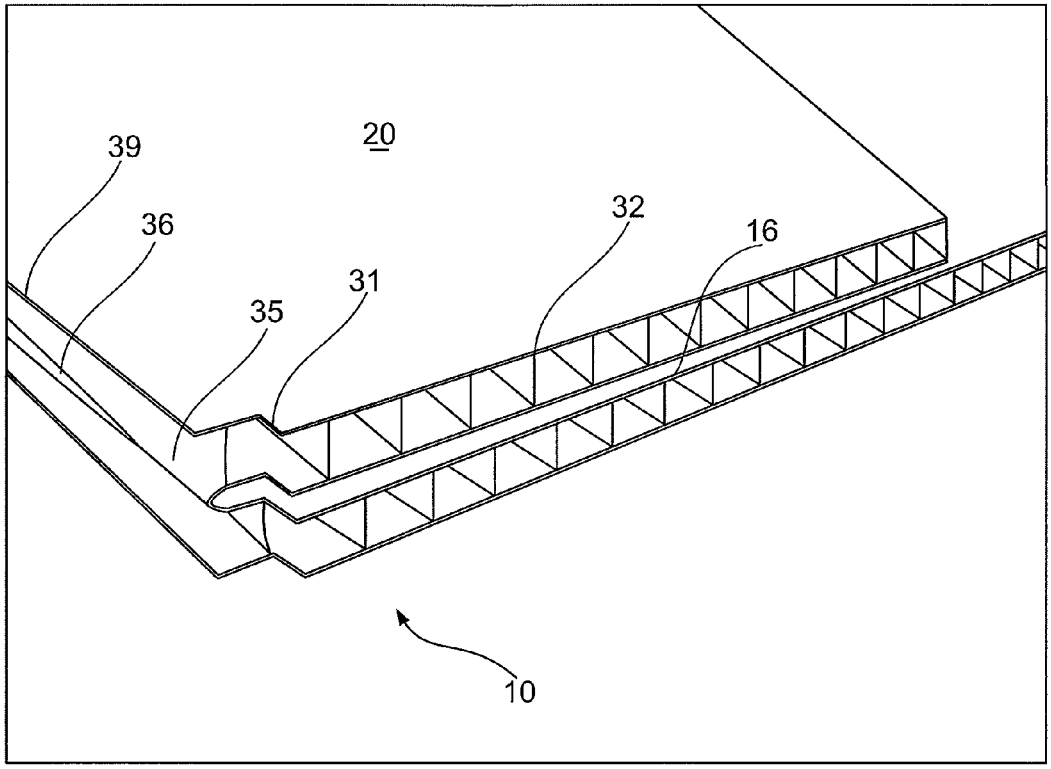
FIG. 5 illustrates a partial bottom left perspective view showing the interior of the embodiment of FIG. 1 without the bottom trim installed and with the left side panel fully closed.
Figure 11:
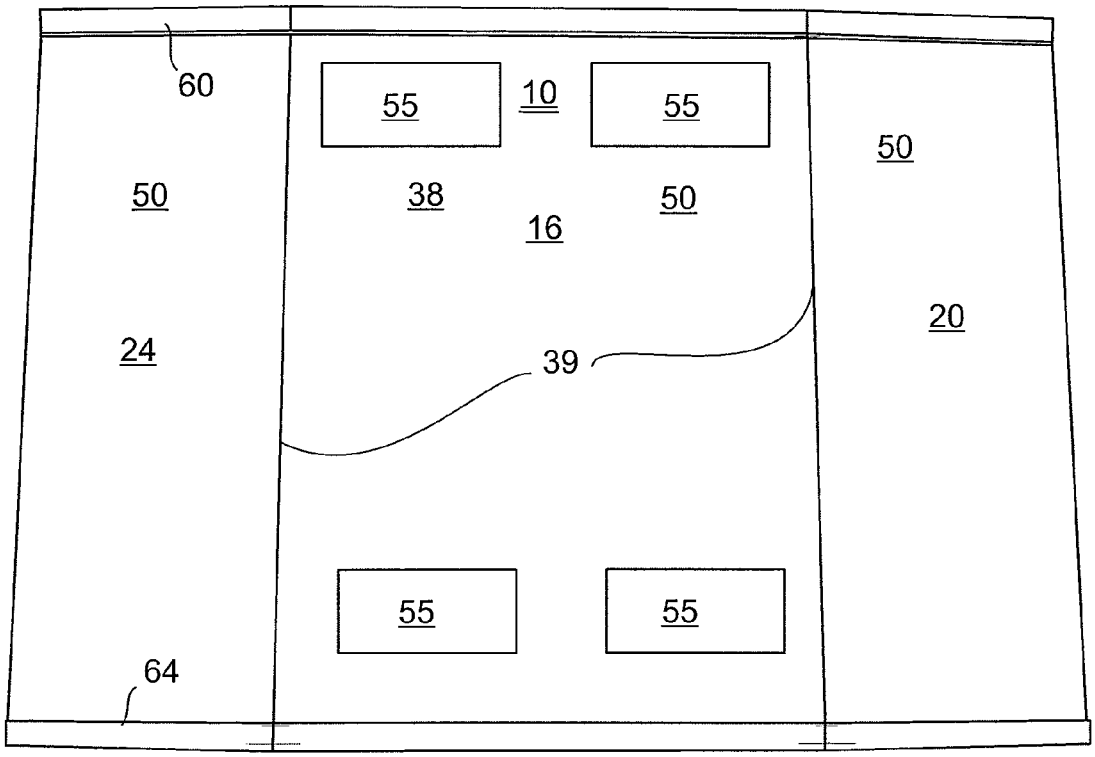
FIG. 11 illustrates a rear elevational view of the embodiment of FIG. 1 with both side panels fully open.

If an I-beam internal structure is used, the ribs of the I-beam may be oriented either horizontally (i.e. widthwise), vertically (i.e. lengthwise), or diagonally, for example, but ribs that run horizontally may tend to provide better control of the overall width of writing board 10. Horizontally oriented ribs also may eliminate scrap and yield the lowest cost to manufacture substrate 30. If substrate 30 is made from a plastic, such as polypropylene, substrate 30 may be manufactured having front face member 34 (as shown in FIG. 4) integrally formed with rear face member 38 (as shown in FIG. 11), which together are integrally formed with a plurality of ribs 32, as shown in FIGS. 4-5.

Figure 6:
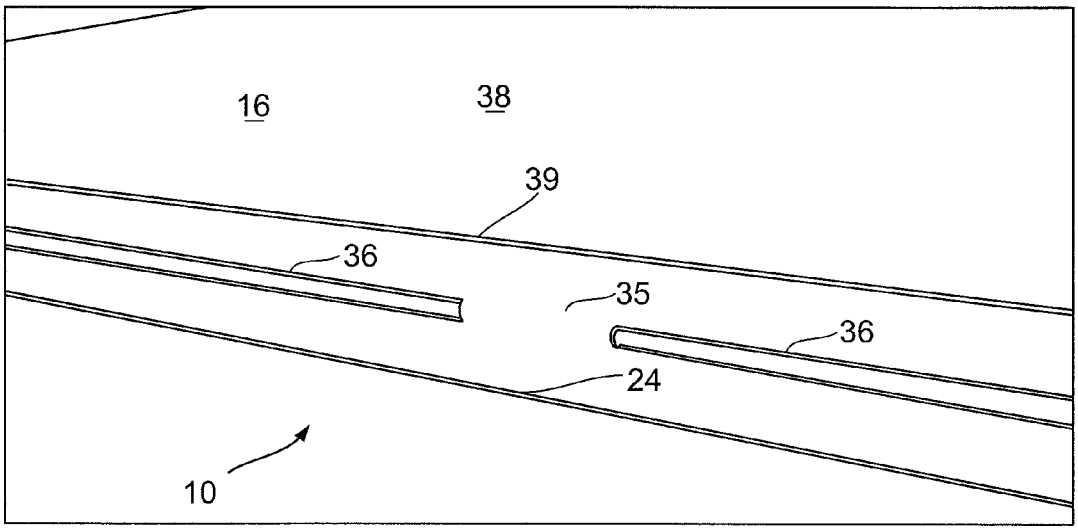
FIG. 6 illustrates a partial bottom left perspective view of the embodiment of FIG. 5 with the left side panel fully closed.
Figure 7:
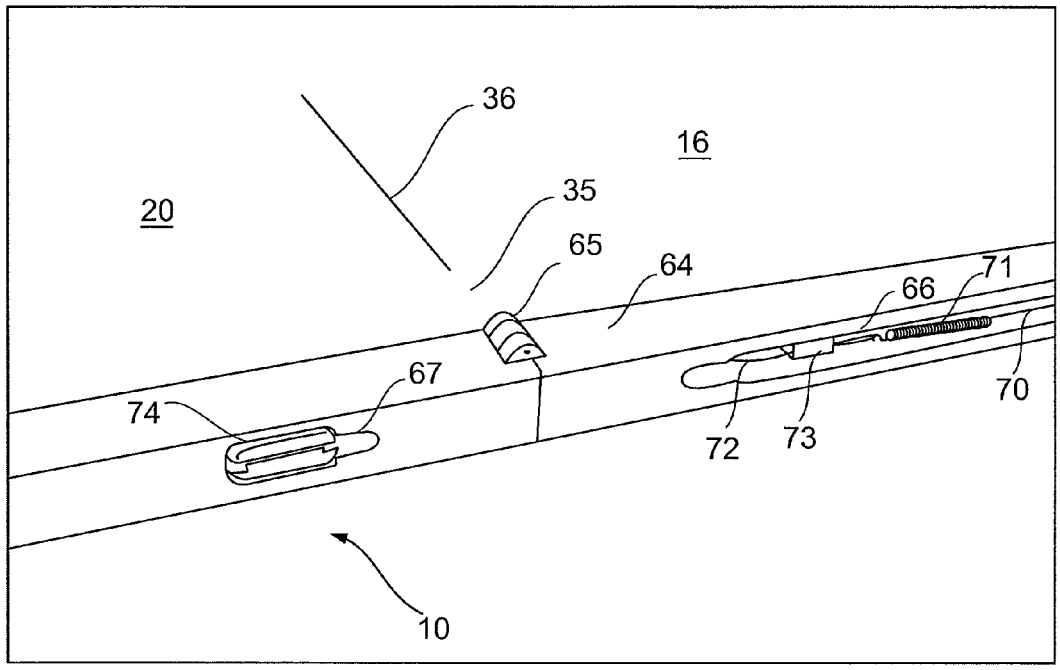
FIG. 7 illustrates a partial bottom left perspective view of the embodiment of FIG. 1 with the left side panel fully open.
Figure 8:
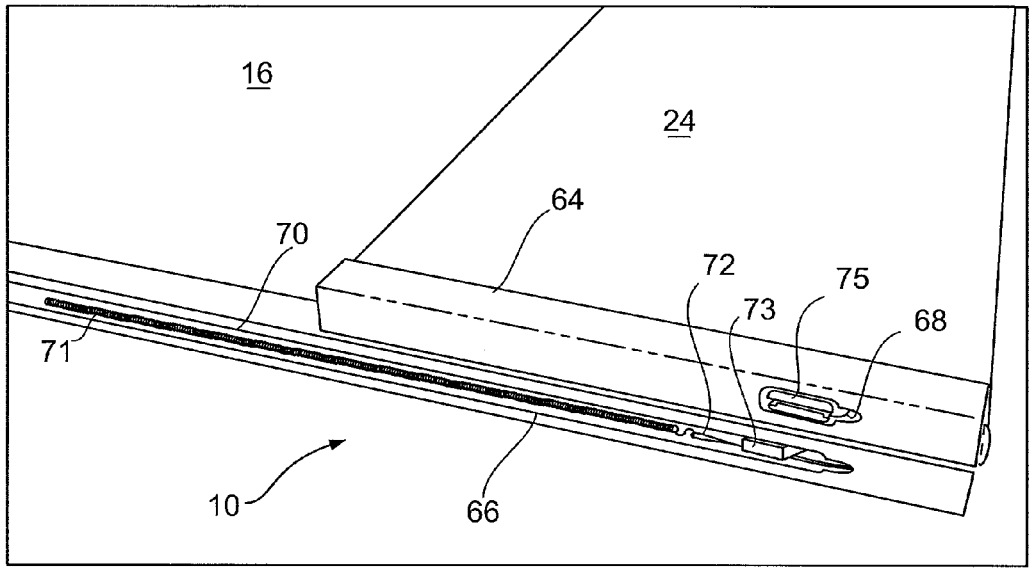
FIG. 8 illustrates a partial bottom right perspective view of the embodiment of FIG. 1 with the right side panel fully closed.
Figure 9:
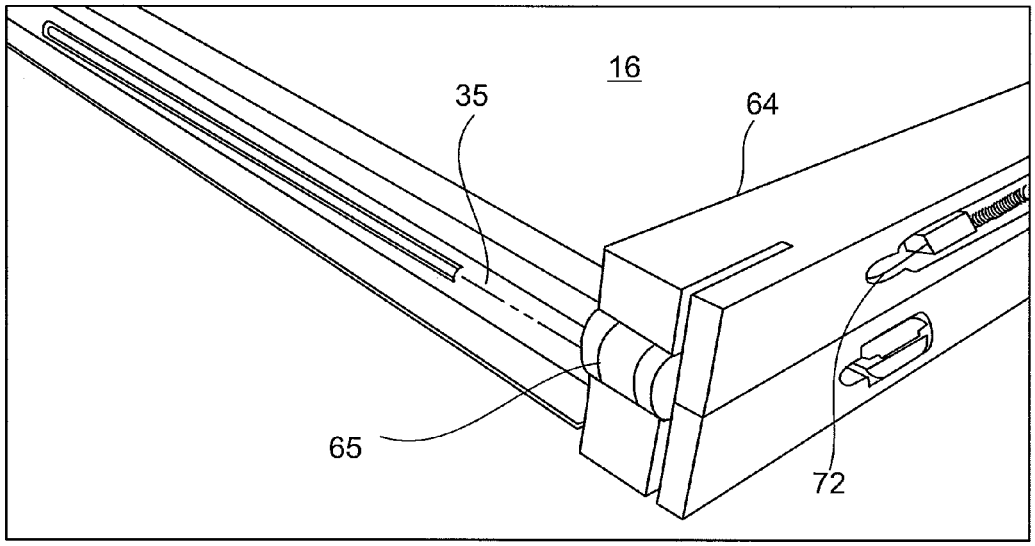
FIG. 9 illustrates a partial rear bottom perspective view of the embodiment of FIG. 1 with the right side panel fully closed underneath the center panel.
Figure 10:
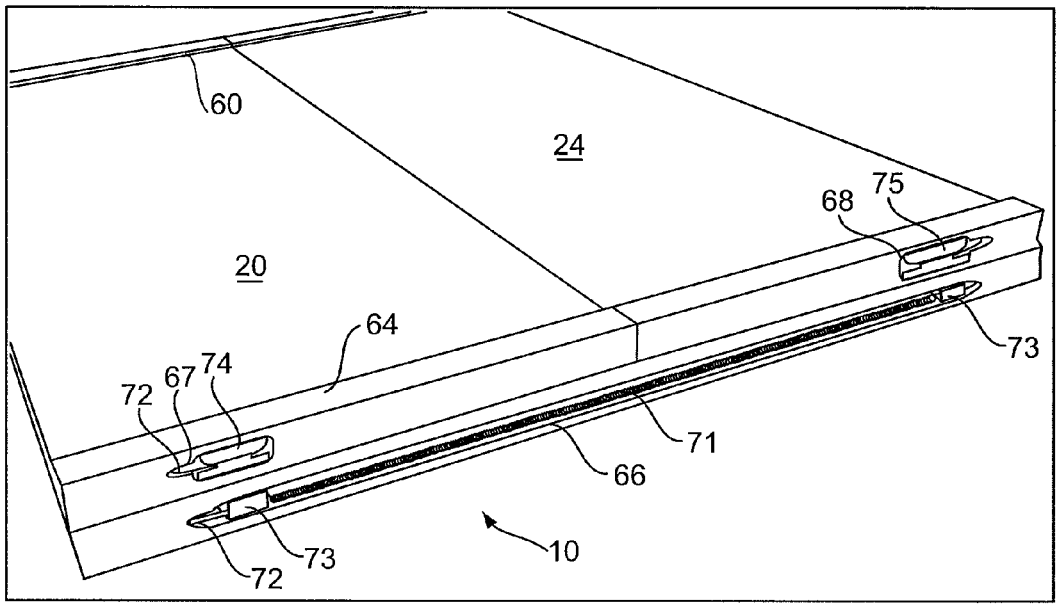
FIG. 10 illustrates a bottom left perspective of the embodiment of FIG. 1 showing both side panels fully closed.

Referring to FIG. 4, a partial view of substrate 30 is shown with right side panel 24 in its fully opened position. To permit unlimited and repetitive opening and closing of right side panel 24 (and left side panel 20, as shown in FIG. 5), front face member 34 may include at least one living hinge 35 to connect left side panel 20 to center panel 16. Likewise, front face member 34 may include at least one living hinge 35 to connect right side panel 24 to center panel 16. To form living hinge 35, rear face member 38 may include back slit 39, as shown in FIGS. 5-6 and 11, leaving front face member completely intact. Alternatively, front face member 34 may include one or more front slits 36, as best shown in FIGS. 3-4, to form a plurality of living hinges 35. The length and quantity of living hinge 35 determines the relative ease to open and close side panels 20, 24 because the relative stiffness of substrate 30 may naturally cause side panels 20, 24 to stay open. Thus, the size and quantity of living hinges 35 depends on the variables that effect the stiffness of substrate 30, such as the choice of material for substrate 30 (which affects its resiliency), and the thickness of front face member 34. It may be necessary, for example, to relieve about 80%-85% of the surface tension of front face member 34 using front slits 36 to prevent side panels 20, 24 from naturally returning to the open position when set to the closed position by the user, and to prevent delamination of dry erase film 50 (if applied to substrate 30, as indicated on FIGS. 3 and 11 but not shown) from substrate 30 over the side panel fold area.

Substrate 30 of writing board 10 may alternatively be fabricated in separate pieces or panels that may be joined together via a separate front face member 34 made of, for example, polypropylene, that is laminated or otherwise adhered to the separate pieces or panels of substrate 30. In this way, writing board 10 may only require one or more front slits 36, if at all, to relieve excess surface tension in front face member 34 as back slitting would be obviated by starting with separate pieces or panels for substrate 30.

If substrate 30 does not alone have dry erase properties, writing board 10 may be configured to include film 50 on one or both of front face member 34 and rear face member 38 or on predetermined portions thereof. Film 50 may comprise any biaxially-oriented polyester film, UV cured polyurethane, polypropylene, or any other product, surface treatment, or coating that may provide substrate 30 with dry erase properties. Film 50 or such other products, surface treatment, or coating may have magnetic properties or non-magnetic properties. Film 50 may act as a carrier for the application of dry erase treatments or coatings if film 50 itself does not have dry erase properties. Depending on the chosen material of film 50 or the subsequent treatment or coating that may be applied to film 50, if any, the thickness of film 50 may range from approximately 0.5 mil thick to approximately 50 mils thick. Film 50 may be laminated, deposited, or adhered to substrate 30 using conventional techniques known to one of skill in the art.

As shown in FIGS. 1-3, writing board 10 may include top trim 60, bottom trim 64, or both, which may be configured to connect to substrate 30 along the top and/or bottom edge of substrate 30. As shown in FIGS. 4-5, the top and bottom edges of substrate 30 may include channel 31 positioned at the bend interface between side panels 20, 24 and center panel 16.

Top trim 60 and bottom trim 64 may provide aesthetic enhancement to the top and/or bottom edge of writing board 10. Either or both of top trim 60 and bottom trim 64 may also provide hidden mechanical enhancement for the operation of writing board 10. For example, top trim 60 and/or bottom trim 64 may include hinge 65 and holding mechanism 70. As described more fully below, holding mechanism 70 may be configured to hold side panels 20, 24 in either the open position or the closed position, as may be desired by the user. Holding mechanism 70 may itself include resilient member 71, which may comprise a spring, for example, and cable 72, cable clamp 73, and anchors 74, 75. Whether holding mechanism 70 is installed in both top trim 60 and bottom trim 64 depends on the force required to maintain side panels 20, 24 in either the open or the closed position and the size of writing board 10.

As shown in FIGS. 7-10, holding mechanism 70 may be located in center slot 66, in left slot 67, and in right slot 68 of bottom trim 64. Resilient member 71 may be positioned in center slot 66 of bottom trim 64. Left anchor 74 may be positioned in left slot 67 of bottom trim 64, and right anchor 75 may be positioned in right slot 68 of bottom trim 64. Cable 72 may connect left anchor 74 to one end of resilient member 71, and another cable 72 may connect right anchor 75 to the opposite end of resilient member 71. Cable clamp 73, which may be positioned on respective ends of resilient member 71, may be used to secure cable 72 to resilient member 71. Respective ends of resilient member 71 may thus be anchored to side panels 20, 24. Holding mechanism 70 may be similarly situated in top trim 60 if desired.

During articulation of left side panel 20 to fully close left side panel 20 from the fully open position, for example, resilient member 71 initially elongates because the distance to left anchor 74 increases. However, as articulation continues beyond a point approximately midway in the articulation of left side panel 20, the force to continue to fully close left side panel 20 will begin to decrease resulting in a decrease in the elongation of resilient member 71. The same result occurs when opening left side panel 20 when initially in the fully closed position, and also when opening or closing right side panel 24. Consequently, the force to open or close either left side panel 20 and right side panel 24 is at a maximum somewhere along the path of articulation of side panels 20, 24 from a fully open position to a fully closed position, or vice versa, and is at a minimum in the fully open position or fully closed position to create a tendency for maintaining either the open or the closed position for side panels 20, 24.

The overall size of writing board 10 may dictate the size and quantity of holding mechanism 70 that may be employed. For example, for a relatively small 9" W×12" L (closed) writing board 10, only one holding mechanism 70 may be required, if at all, which may be positioned in bottom trim 64.

If, for example, writing board 10 measures 18" W×24" L (closed), then one holding mechanism 70 may be required at the bottom of writing board 10 and another holding mechanism 70 may be required at the top of writing board 10 to assure proper operation and control of the opening and closing of side panels 20, 24. Thus, writing board 10 may include top trim 60, as shown in FIGS. 1-3 and 11, which may be similarly configured as bottom trim 64 to house holding mechanism 70, or configured simply to visually balance the presence of bottom trim 64.

If the size of writing board 10 increases still further to, for example, 36" W×48" L (closed), a combination of four holding mechanisms 70 may be employed using the same techniques described above to hold open or hold closed side panels 20, 24. In this way, left side panel 20 may itself have a holding mechanism 70 be positioned in top trim 60 and also in bottom trim 64 to hold open or hold close left side panel 20. Right side panel 24 may be similarly configured with a holding mechanism positioned in top trim 60 and also in bottom trim 64 to hold open or hold closed right side panel 24. For each resilient member 71, the end opposite the respective anchors 74, 75 would require anchoring to trims 60, 64, for example, or to the other of respective resilient member 71 that is located within the same center slot 66 in the same trim 60 or 64. Alternatively, any one of a range of possible known techniques for fixating the opposing end of resilient member 71 may be employed in foldable writing board applications having multiple resilient members 71.

Top trim 60 and bottom trim 64 may be made from any durable, low cost, and lightweight material that may, for example, be injection molded, such as high impact polystyrene ABS plastic, or polycarbonate. In an economy version of writing board 10, however, writing board 10 may not necessarily include either top trim 60 or bottom trim 64. Although no holding mechanism 70 as described above would be present, the economy version of writing board 10 may, instead, include a magnet installed or embedded in the respective center, left, and/or right panels 16, 20, 24 to magnetically hold side panels 20, 24 in the closed position.

Referring again to FIG. 11, writing board 10 may also include mount 55 to permit securing or mounting of writing board 10 onto any surface, such as a vertical surface. Mount 55 may comprise, for example, one or more conventional picture hanger mounts or one or more hook and loop strips as may be necessary, depending on the overall size and weight of writing board 10.

In some embodiments of writing board 10, rear face member 38 may include back slit 39, but front face member 34 may not necessarily include front slit 36 thus forming a single living hinge 35 in front face member 34. Whether front face member 34 includes one or more front slits 36, which facilitates the opening and closing of side panels 20, 24 by reducing the natural tendency of side panels 20, 24 to always remain in the open position, may depend, for example, on the thickness of front face member 34, the stiffness of the chosen material for substrate 30 and/or film 50 (if present), the overall size of writing board 10, and the size and quantity of holding mechanism 70.

Figure 12C:
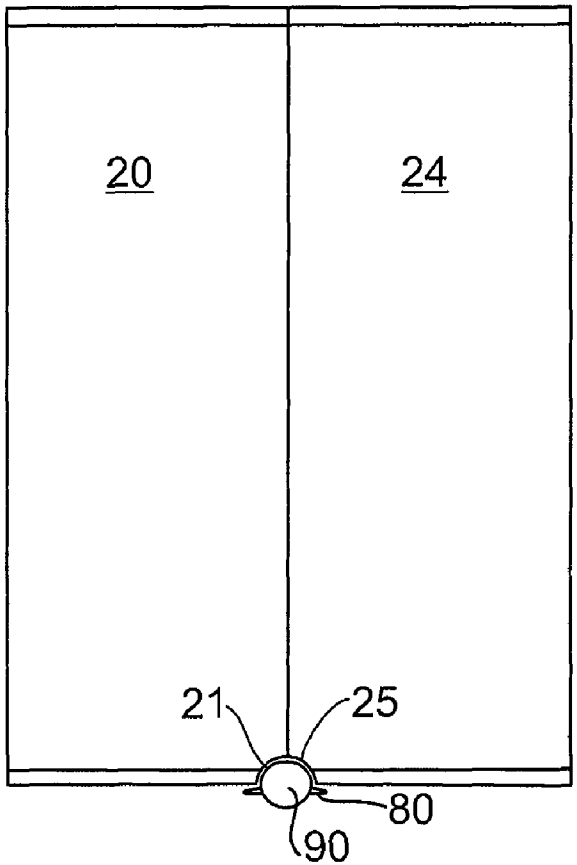
FIGS. 12*a-c* illustrate front elevational views of another embodiment of the invention showing the left and right side panels fully closed.
Figure 12B:
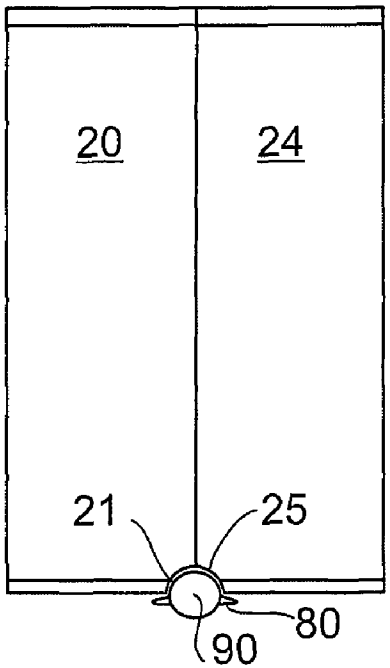
Figure 12A:
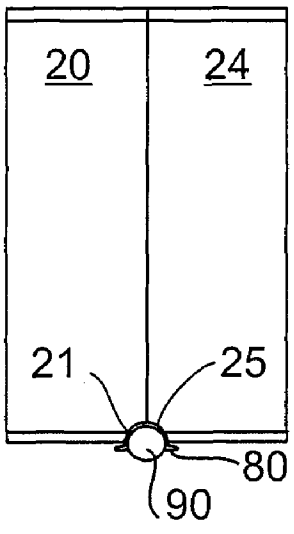
Figure 13:
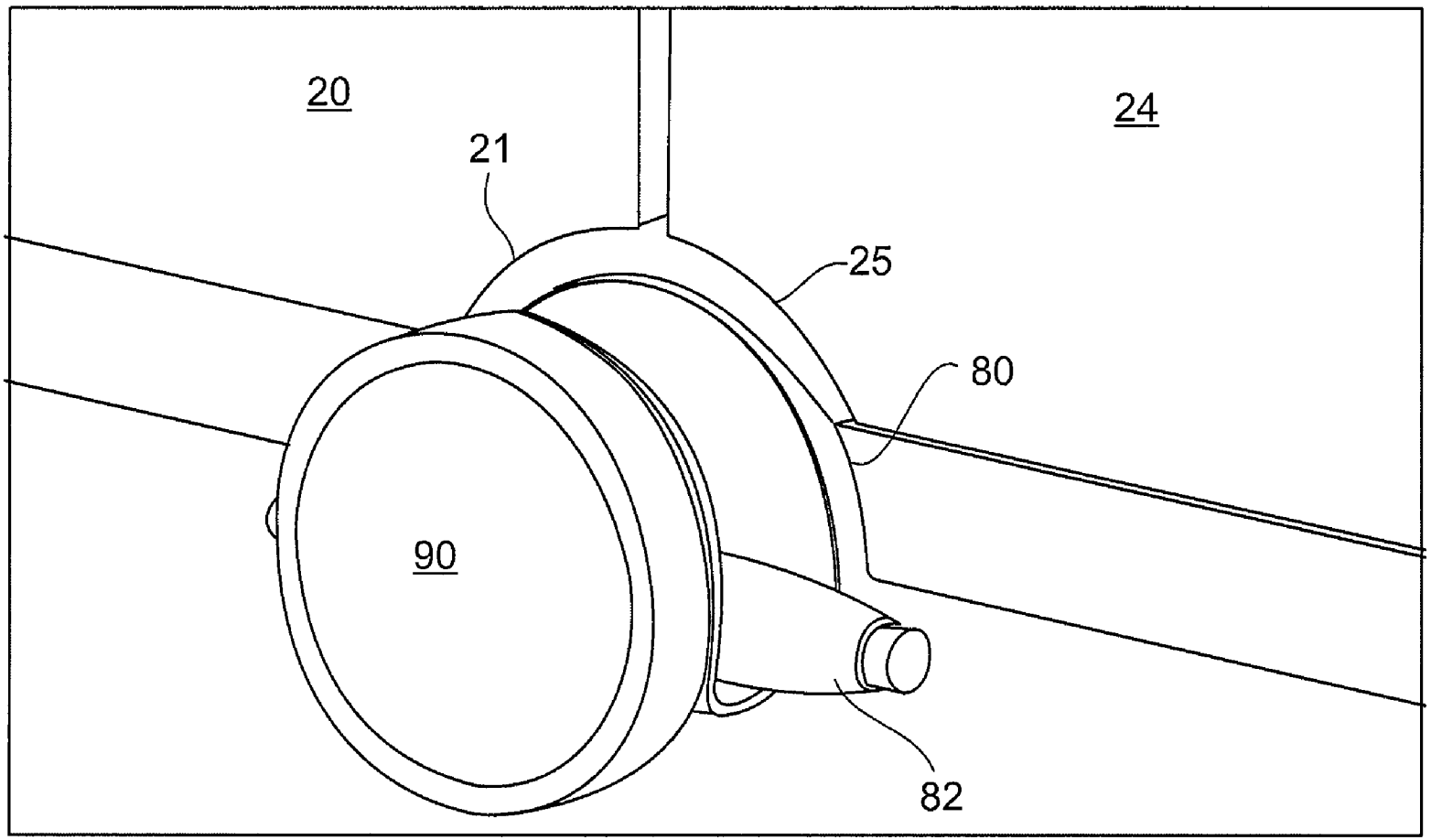
FIG. 13 illustrates a partial right perspective of an eraser, a writing utensil, and an eraser and writing utensil holder of the embodiment of FIGS. 12*a-c;*
Figure 14:
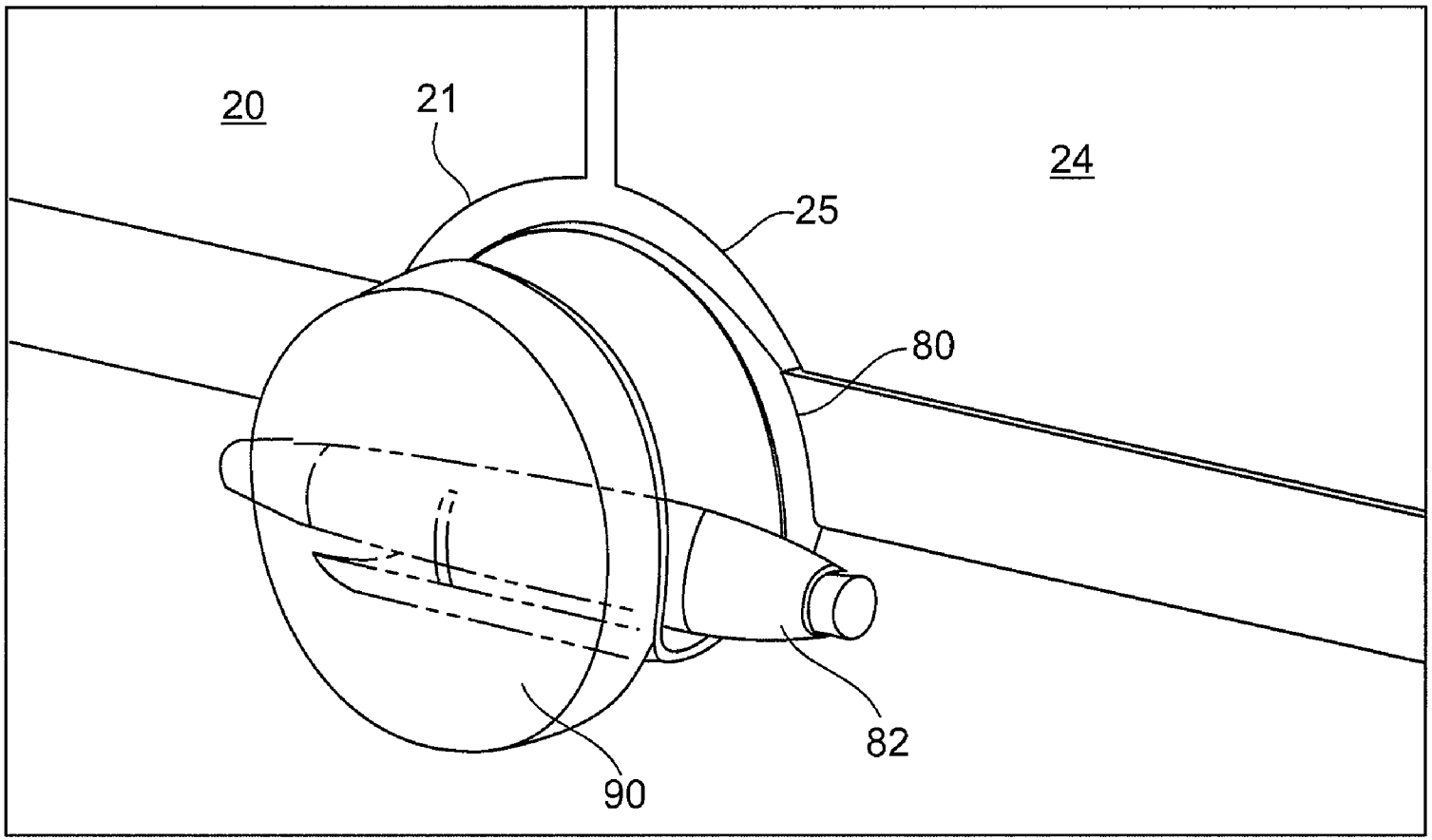
FIG. 14 illustrates a partially transparent perspective of the embodiment shown in FIG. 13.
Figure 15A:
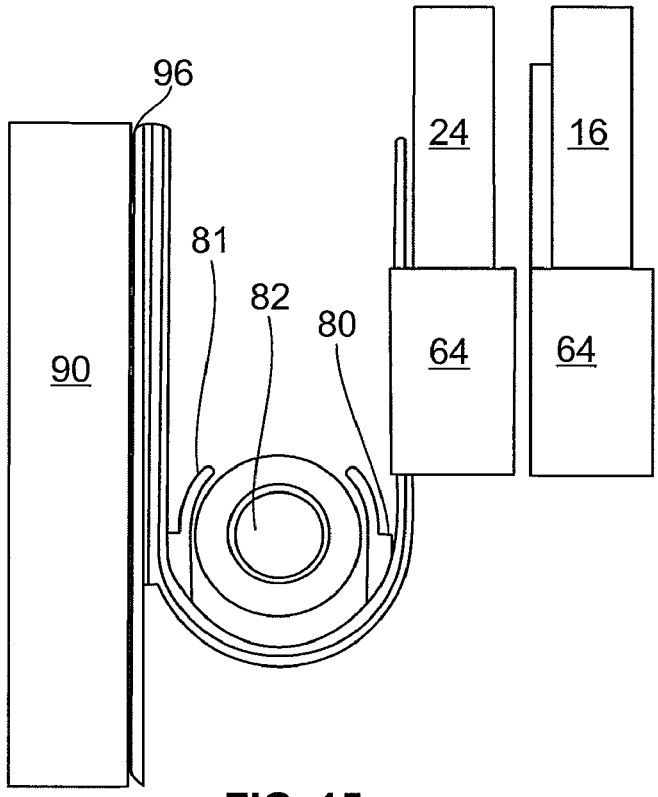
FIGS. 15*a-c* illustrate partial right side elevational views of the eraser and writing utensil holder shown in FIG. 13.
Figure 15B:
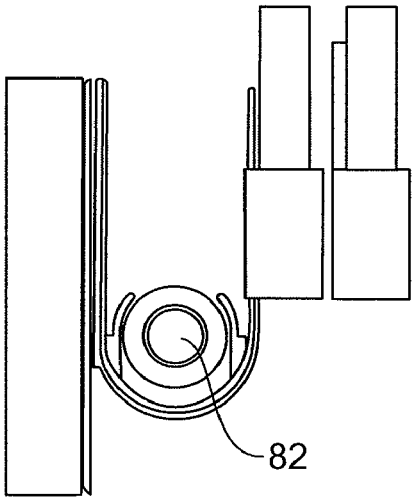
Figure 15C:
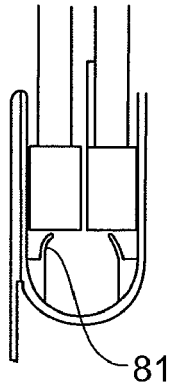
Figures 16A, 16B, 16C, 16D, 16E:
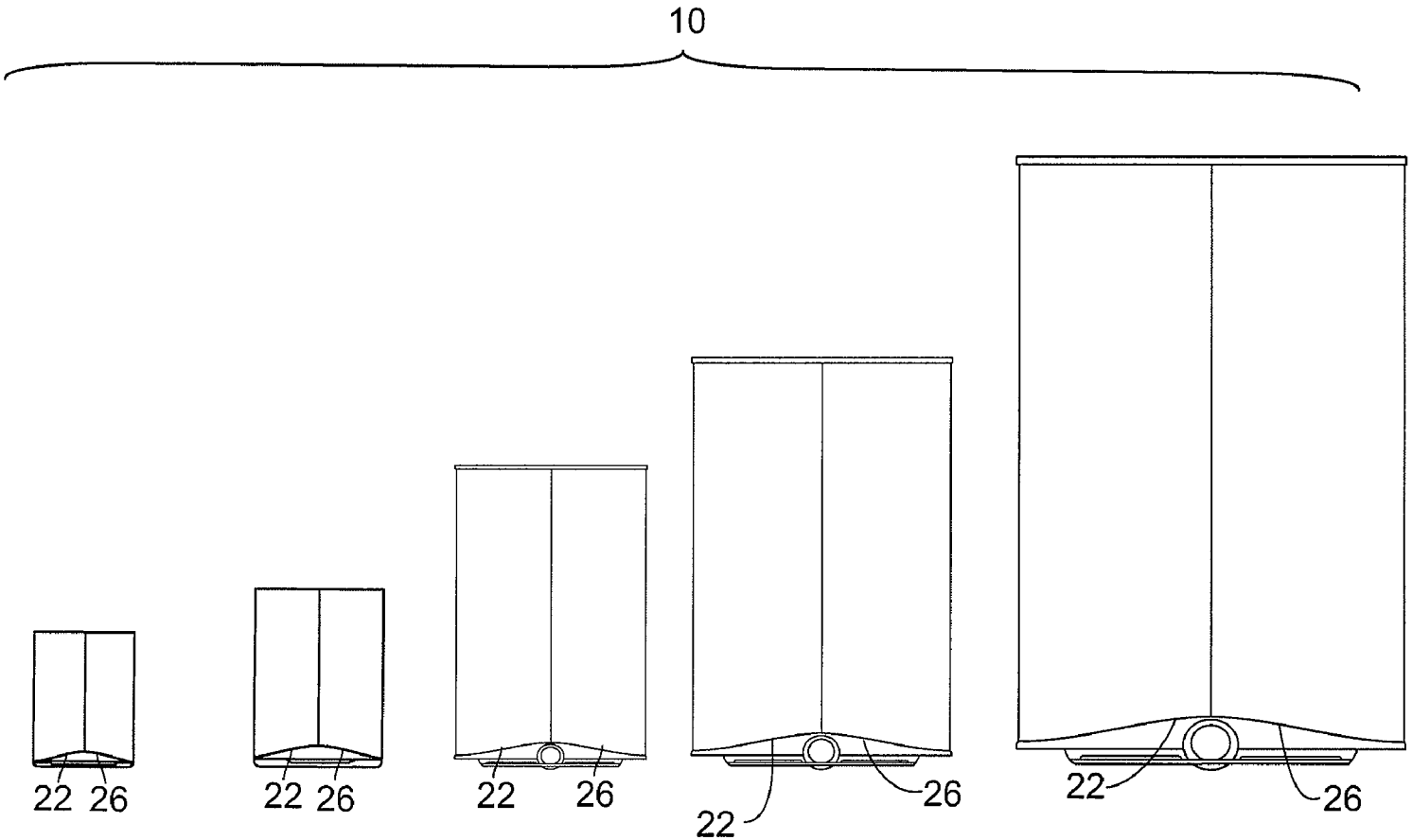
FIGS. 16*a-e* illustrates front elevational views of another embodiment of the invention showing the left and right side panels fully closed.
Figure 17:
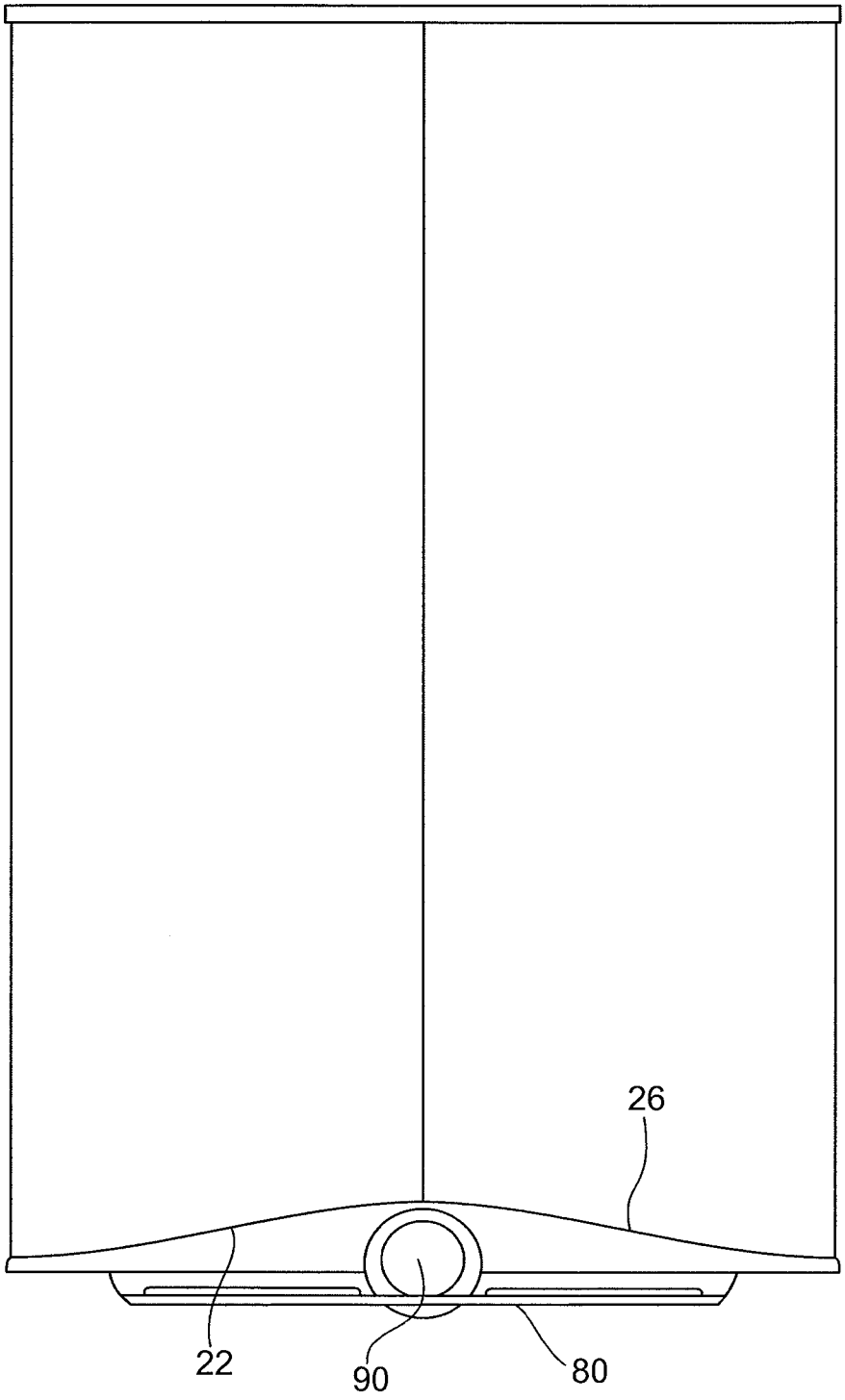
FIG. 17 illustrates another front elevational view of the embodiment of FIG. 16*d* showing the left and right side panels fully closed.
Figure 18:
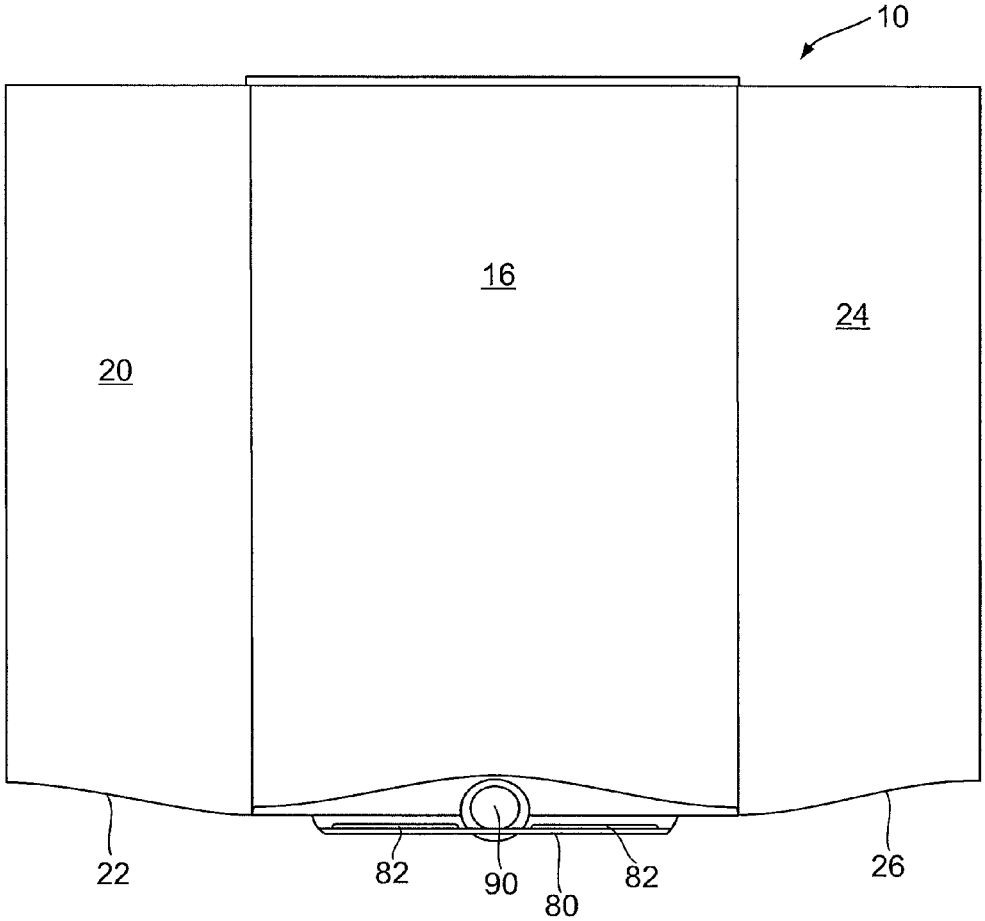
FIG. 18 illustrates another front elevational view of the embodiment of FIG. 17 showing the left and right side panels fully open.
Figure 19:
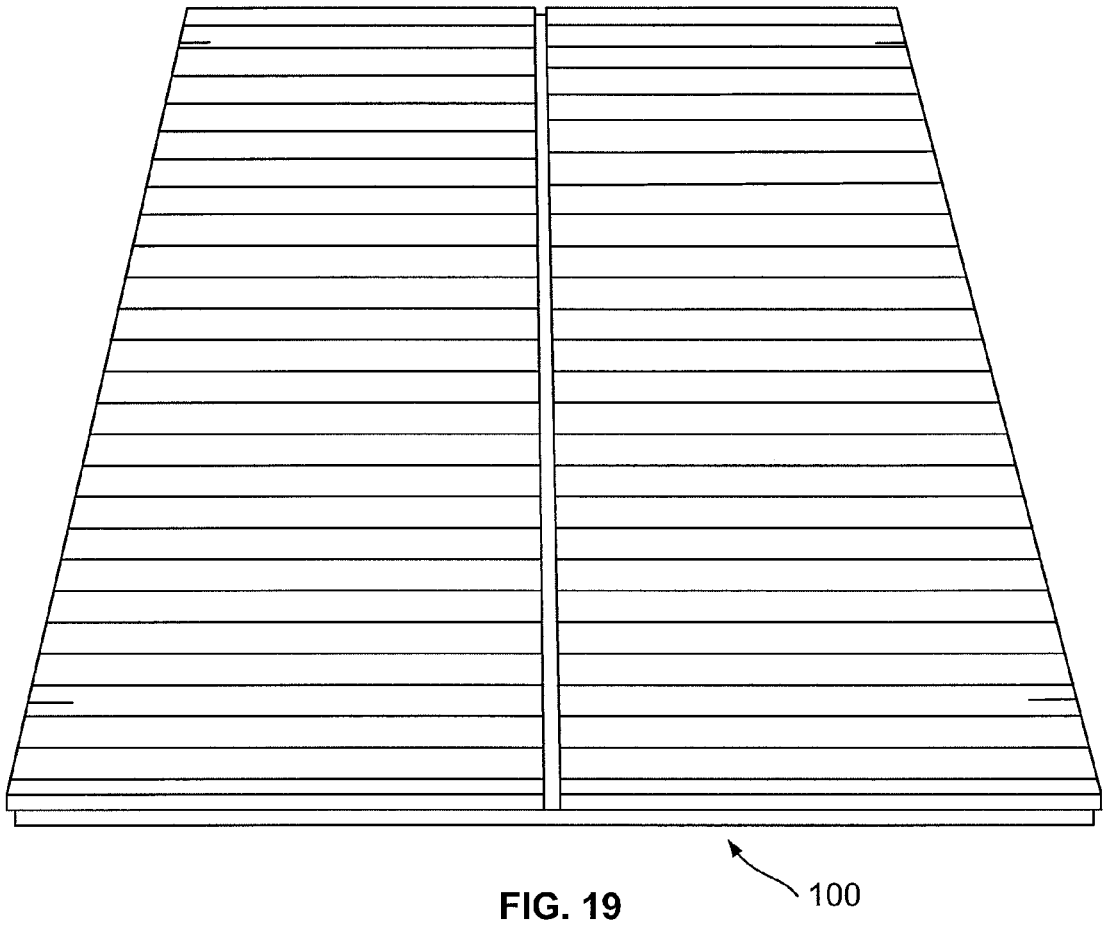
FIG. 19 illustrates a front bottom perspective view of a substrate of another embodiment of the present invention showing both side panels fully closed.
Figure 20:
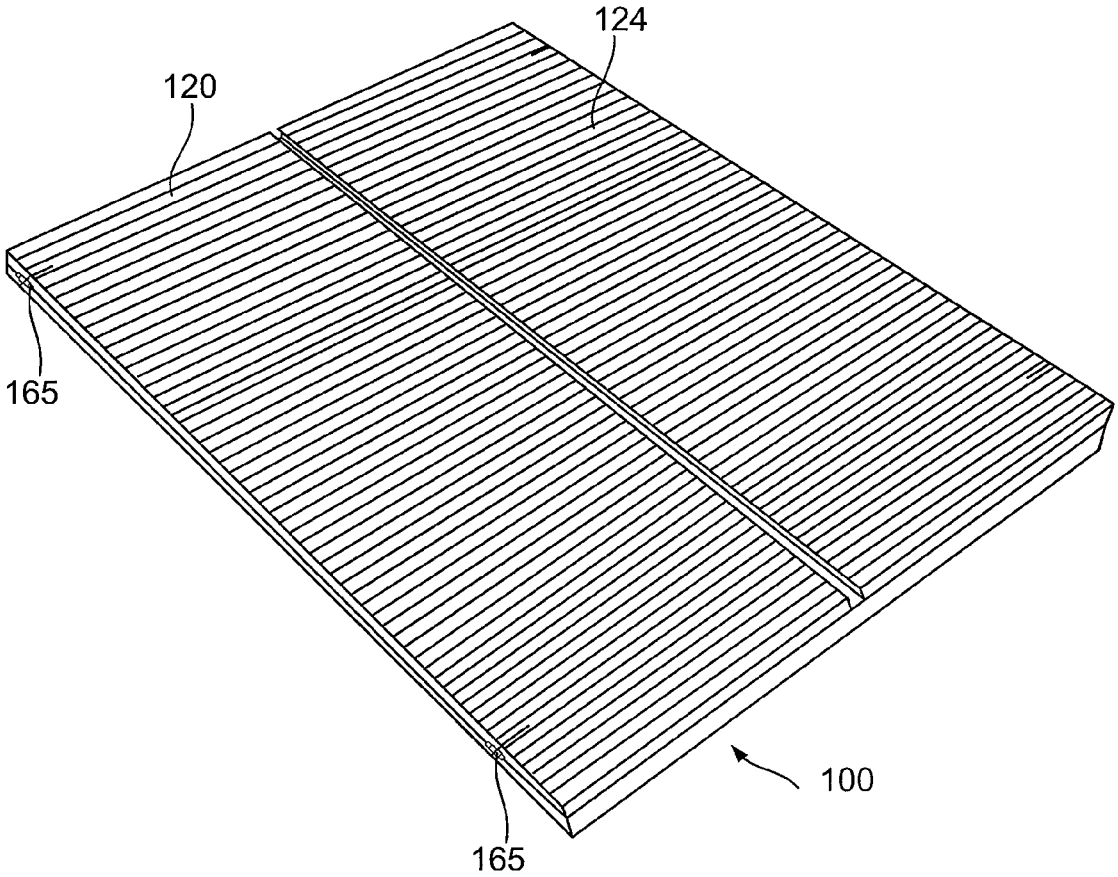
FIG. 20 illustrates a left perspective view of the embodiment of FIG. 19.

As shown in FIGS. 12*a*-12*c* and FIGS. 13-14, writing board 10 may include writing instrument holder 80 and eraser 90. Writing instrument holder 80, as shown in FIGS. 13-14 and in FIGS. 15*a*-15*c*, may include clip 81 for resiliently holding writing instrument 82 through a conformal receptacle on holder 80 having an interference fit with writing instrument 82. Eraser 90, as shown in these figures, may be ergonomically shaped in the form of a puck or any other shape that is conducive for holding in one's hand. Eraser 90 may be magnetically connected to writing instrument holder 80 or may be connected using hook and loop fasteners or any other releasable fastening means at attachment 96. Writing instrument holder 80 may be configured to hold one or more writing instruments 82. In one embodiment, as shown in FIGS. 17-18, writing instrument holder 80 may comprise a tray for receiving one or more writing instruments 82.

Left side panel 20 and right side panel 24 may comprise any number of configurations, such as having corners that are squared, such as shown in FIGS. 1-3. Alternatively, left side panel 20 and right side panel 24 may each include a rounded corner at left outside corner 21 and right outside corner 25, as shown in FIGS. 12*a*-12*c*. In yet another alternative configuration, as shown in FIGS. 16*a*-16*e* and FIGS. 17-18, left bottom edge 22 and right bottom edge 26 of left side panel 20 and right side panel 24, respectively, may comprise a scalloped shape. In this way, left outside corner 21 and right outside corner 25 may be configured to clear writing instrument holder 80 and eraser 90 when opening or closing side panels 20, 24 while promoting the visual appeal of writing board 10 without sacrificing a significant amount of writing space on writing board 10.

Another embodiment of the present invention is shown in FIGS. 19-34 as foldable dry erase writing board 100. Writing board 100 may include all of the various panel sizes, features, material and material properties, and may also function the same, as writing board 10 in FIGS. 1-18, as described above. For this reason, identical numerals with the addition of the prefix "1" are used herein and in FIGS. 19-34 to reference identical parts as described above for writing board 10.

Figure 21:
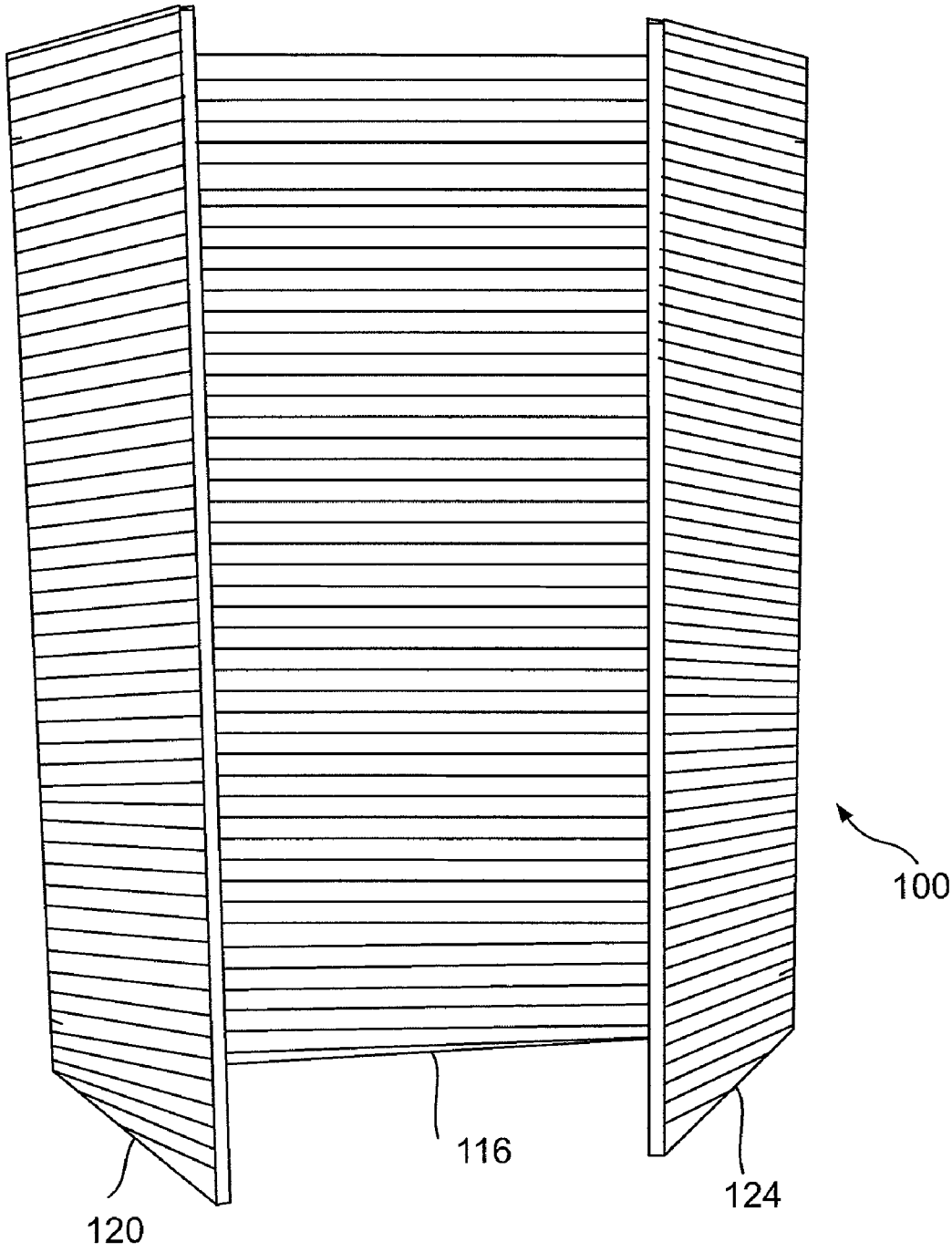
FIG. 21 illustrates a partially articulated front perspective view of the embodiment of FIG. 19.
Figure 22:
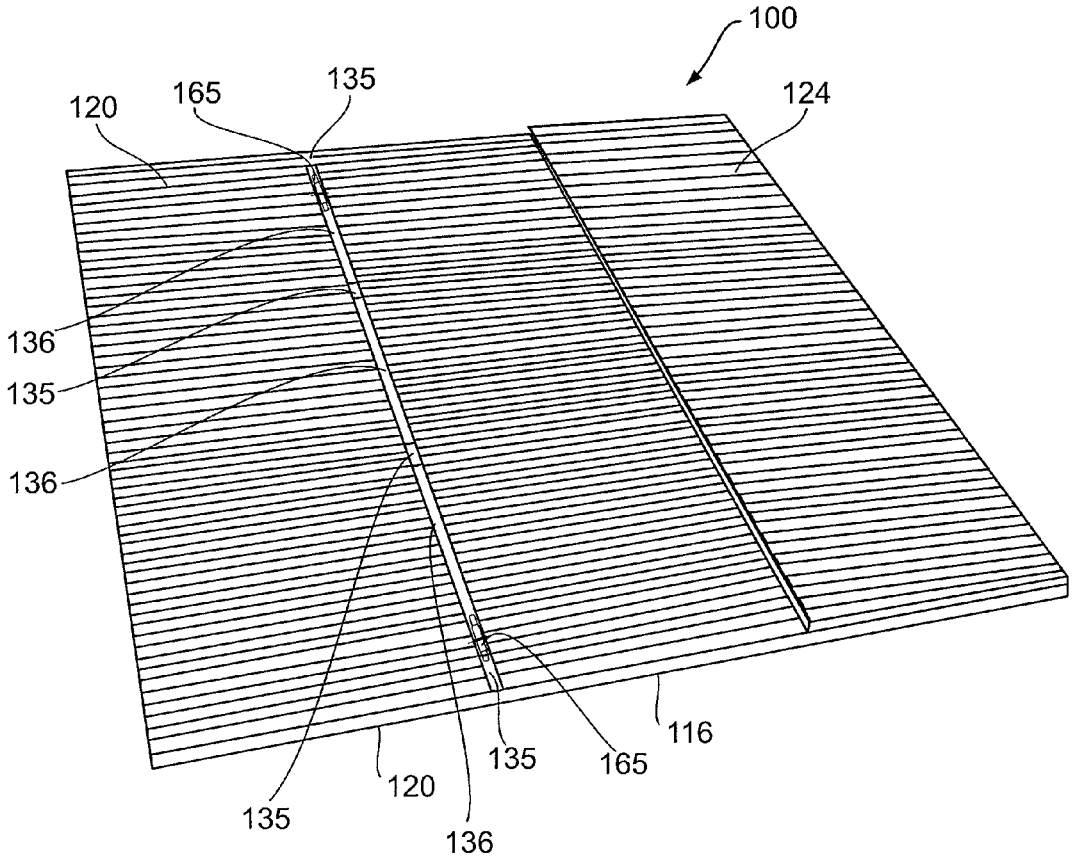
FIG. 22 illustrates a front perspective view of the embodiment of FIG. 19 with the right side panel fully-closed.
Figure 23:
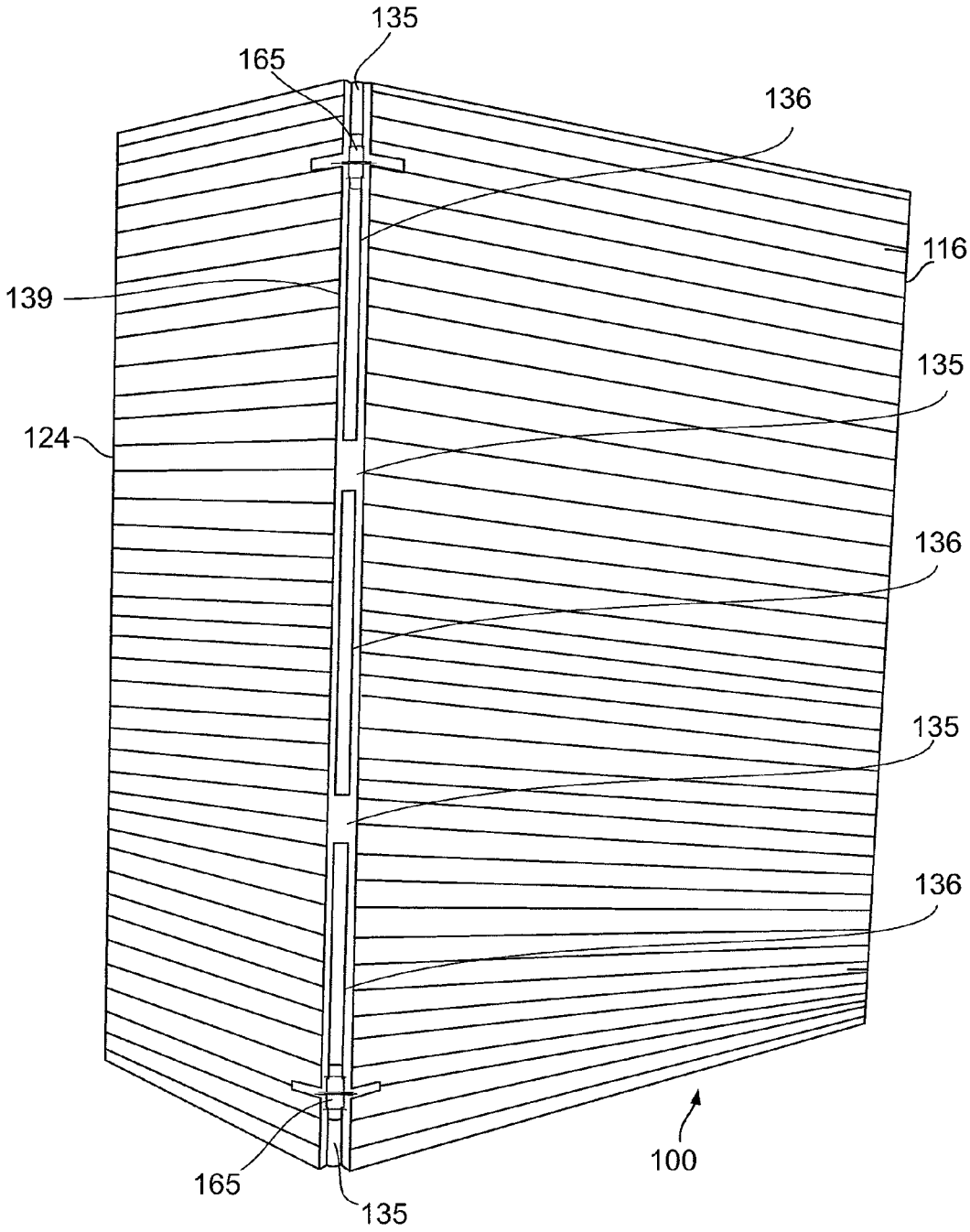
FIG. 23 illustrates a partially articulated rear perspective view of the embodiment of FIG. 19.
Figure 24:
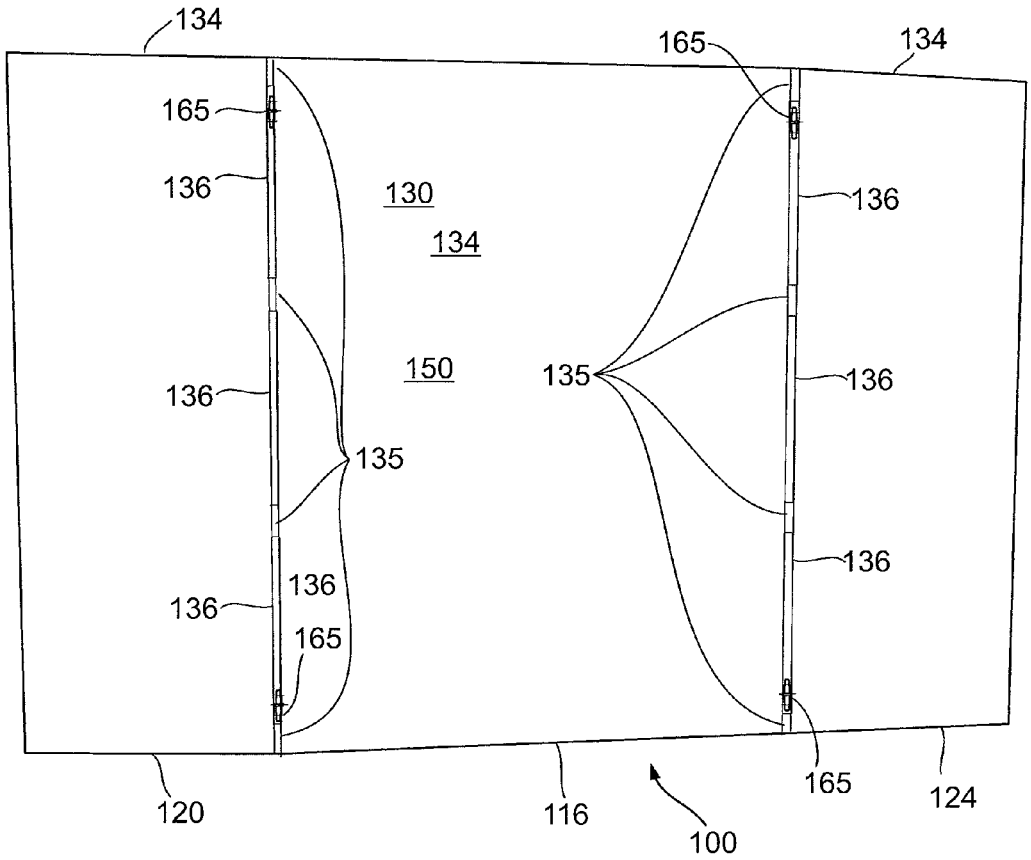
FIG. 24 illustrates a front elevational view of the embodiment of FIG. 19 showing both panels fully open.
Figure 25:
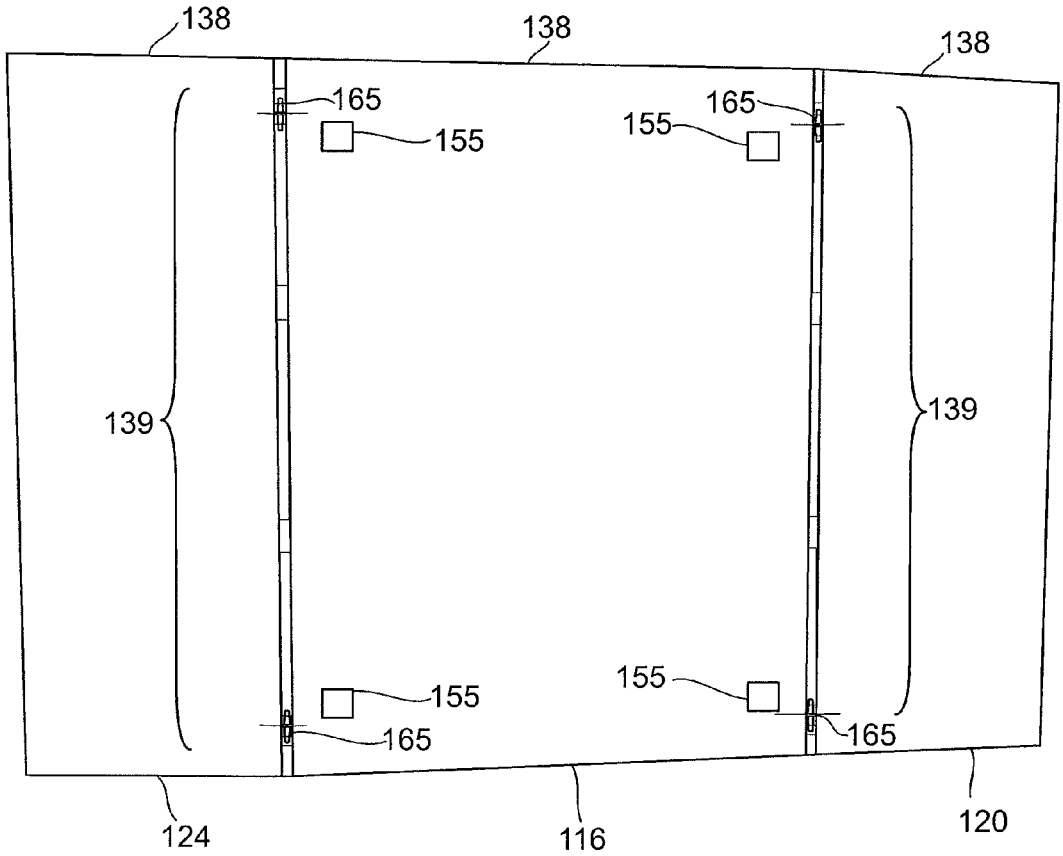
FIG. 25 illustrates a rear elevational view of the embodiment of FIG. 19 showing both panels fully open.
Figure 26:
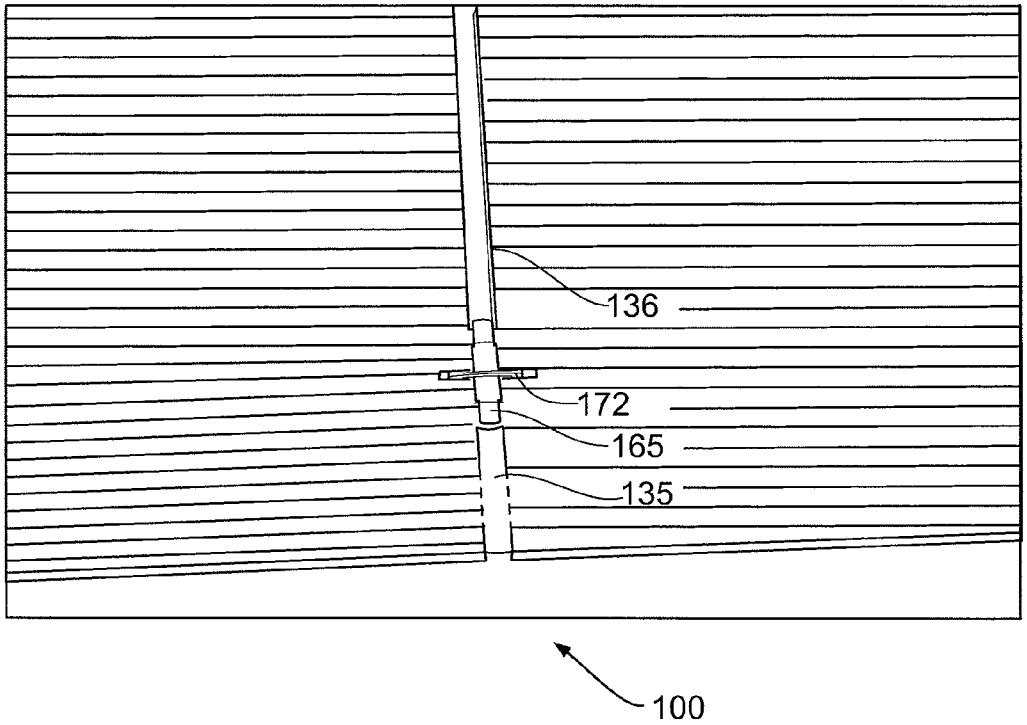
FIG. 26 is a partial front detail view of the embodiment of FIG. 19 showing a hinge, a front slit, and a living hinge.
Figure 27:
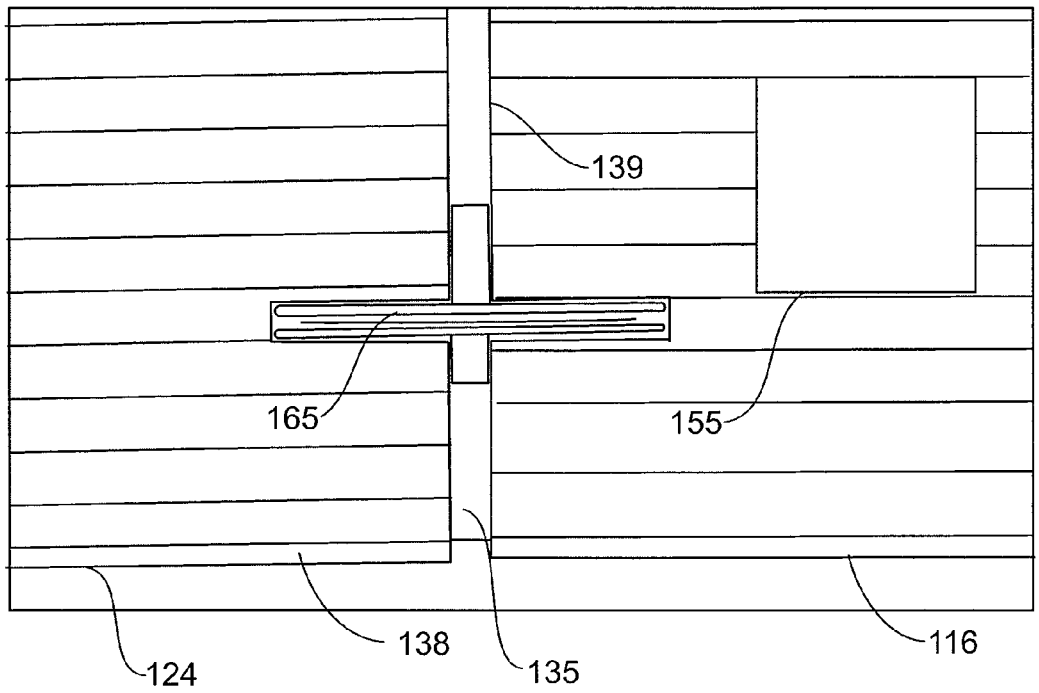
FIG. 27 is rear partial detail view of the embodiment of FIG. 19 showing a hinge and a back slit.
Figure 28:
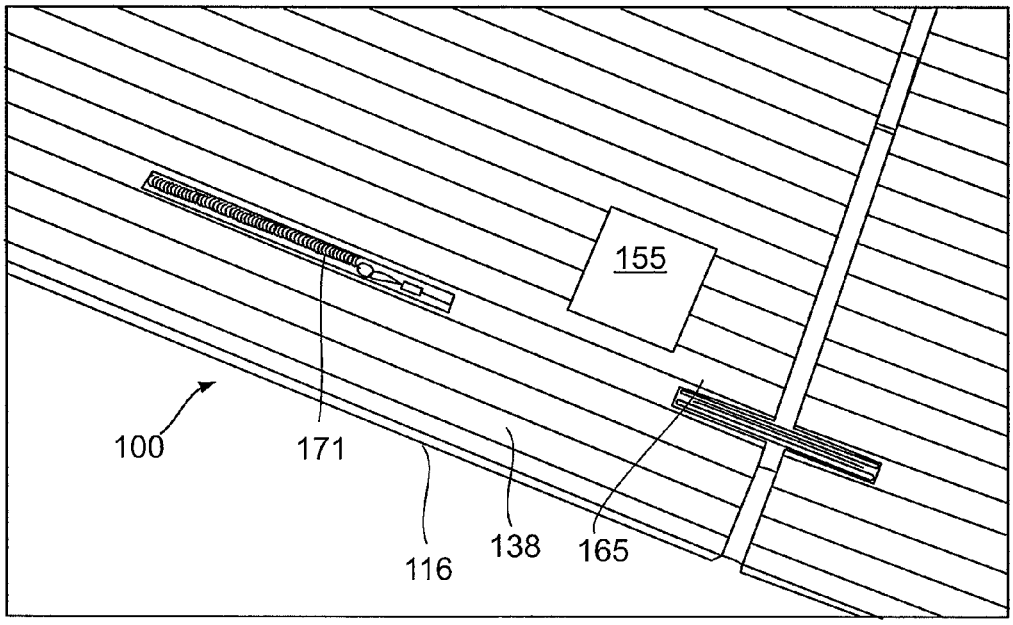
FIG. 28 is a partial detail cutaway view of the embodiment of FIG. 19 showing a portion of a holding mechanism installed within a horizontal flute.

For example, as shown in FIG. 21, writing board 100 may include center panel 116, left side panel 120, and right side panel 124, which may articulate open and closed as described above for writing board 10. In addition, as best shown in FIGS. 24-25, writing board 100 may include lightweight yet sturdy substrate 130, living hinge 135, front slit 136, and backslit 139. Writing board 100 may also be fabricated from similar materials as writing board 10 and with the I-beam internal structure described above for writing board 10 where ribs 132 may be oriented either horizontally, vertically, or diagonally, for example.

Like substrate 30, substrate 130 may itself have properties conducive for writing thereon to be easily removed. Alternatively, as more fully described below, a film or other surface treatment or coating may be applied to one or more surfaces of substrate 130 for this purpose.

Substrate 130 may comprise any one of a number of materials that are lightweight, strong and inexpensive. For example, substrate 130 may be formed from a plastic, such as polypropylene copolymer, or may be formed from other common materials of construction, such as corrugated paper or foam core. Substrate 130 may be formed with a solid, corrugated, porous, or hollow structure, such as an I-beam structure, a honeycomb structure, a cellular structure, or any one of a number of other structural forms to provide a lightweight, strong, and inexpensive structure.

Figure 29:
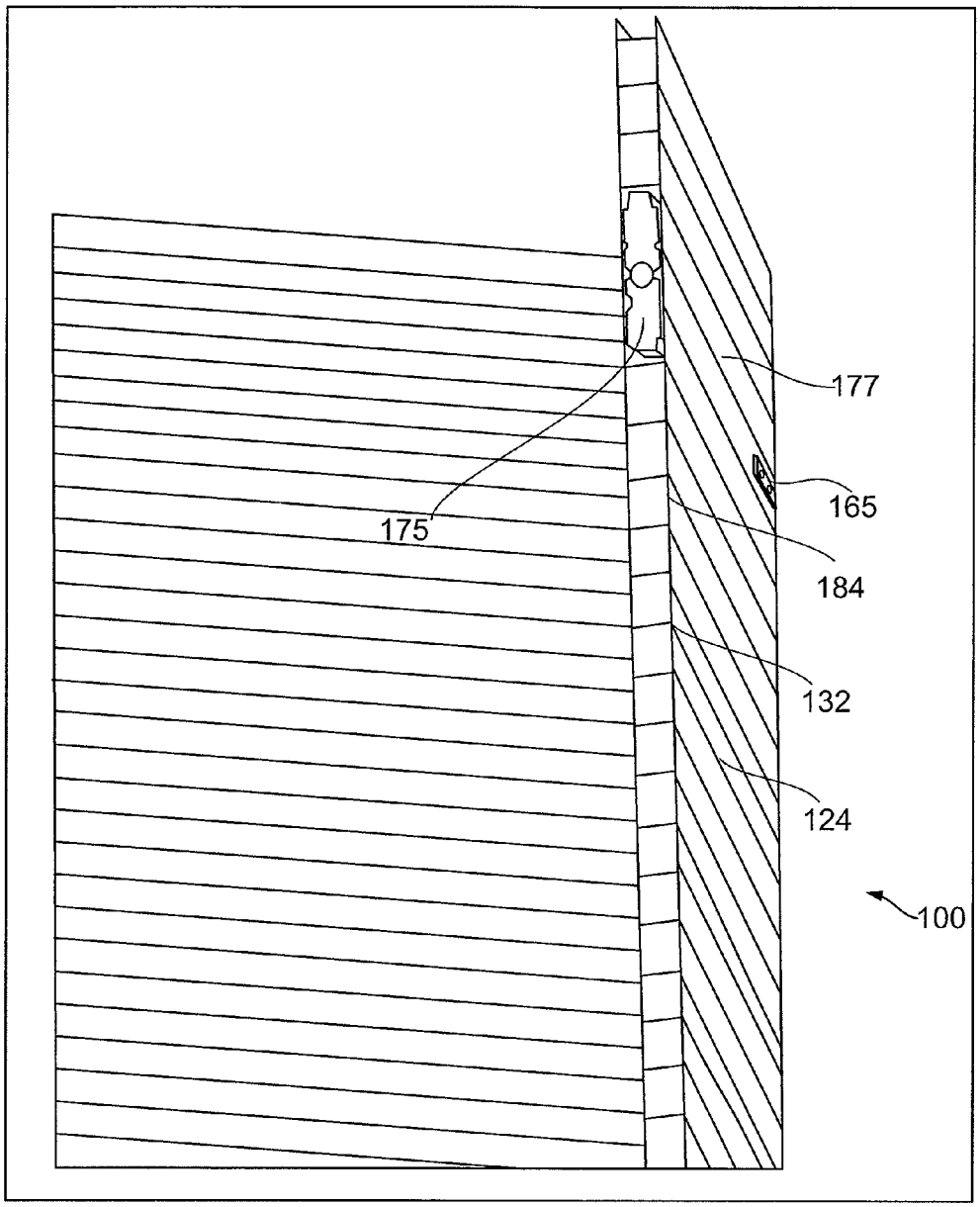
FIG. 29 illustrates a partially-articulated front perspective view of the embodiment of FIG. 19 showing a right anchor of the holding mechanism installed in a flute and the right side panel.

If an I-beam internal structure is used, the ribs of the I-beam may be oriented either horizontally, vertically, or diagonally, for example, but ribs that run horizontally may tend to provide better control of the overall width of writing board 100. Horizontally oriented ribs also may eliminate scrap and yield the lowest cost to manufacture substrate 130. In addition, as described below, horizontally oriented ribs may facilitate the installation and securement of panel holding mechanism 170. If substrate 130 is made from a plastic, such as polypropylene, substrate 130 may be manufactured having front face member 134 (as shown in FIG. 24) integrally formed with rear face member 138 (as shown in FIG. 25), which together are integrally formed with a plurality of ribs 132, as shown in FIG. 29.

If substrate 130 does not alone have dry erase properties, writing board 100 may be configured to include dry erase film 150 (as indicated on FIG. 24 but not shown) on one or both of front face member 134 and rear face member 138 or on predetermined portions thereof. Film 150 may comprise any biaxially-oriented polyester film, UV cured polyurethane, polypropylene, or any other product, surface treatment, or coating that may provide substrate 130 with dry erase properties. Film 150 or such other products, surface treatment, or coating may have magnetic properties or non-magnetic properties. Film 150 may act as a carrier for the application of dry erase treatments or coatings if film 150 itself does not have dry erase properties. Depending on the chosen material of film 150 or the subsequent treatment or coating that may be applied to film 150, if any, the thickness of film 150 may range from approximately 0.5 mil thick to approximately 50 mils thick. Film 150 may be laminated, deposited, or adhered to substrate 130 using conventional techniques known to one of skill in the art.

Unlike writing board 10, however, writing board 100 may not necessarily include a top trim or a bottom trim. And if a top or a bottom trim is included, holding mechanism 170 of writing board 100, which may help to maintain the open or closed position of panels 120 and 124, may not necessarily be mounted in the top or bottom trim. Instead, one or more sets of holding mechanism 170 may be integrated internally in writing board 100 within one or more internal flutes 184 of writing board 100, thus minimizing the number of parts needed for writing board 100.

Figure 30:
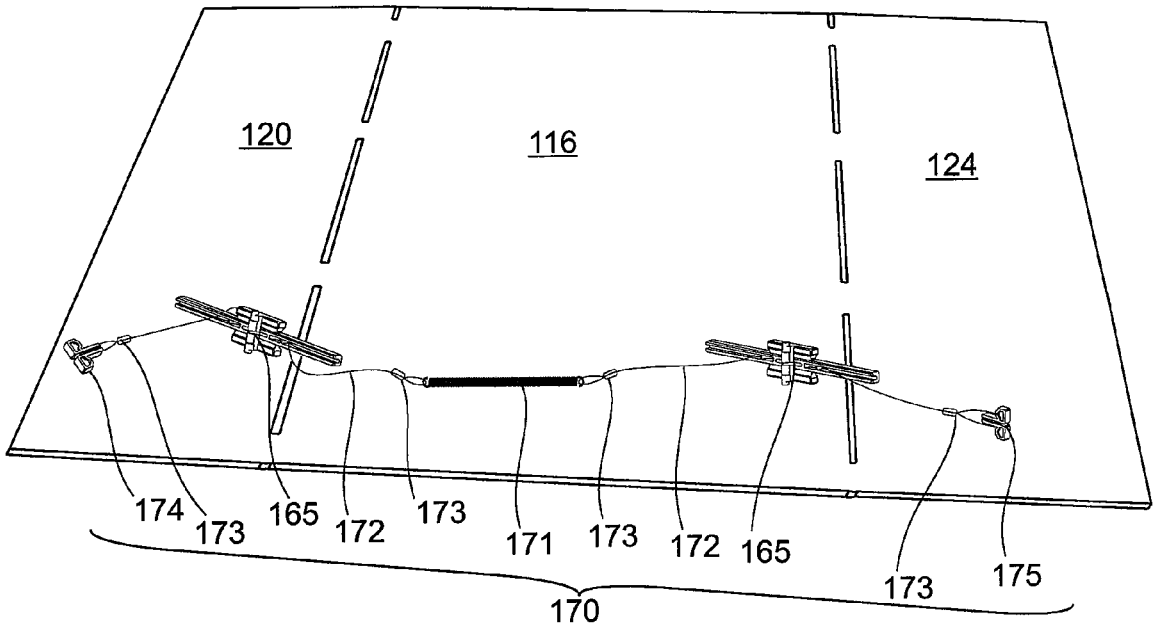
FIG. 30 illustrates a bottom front perspective view of the embodiment of FIG. 19 showing the panel holding mechanism removed from the writing board to illustrate its component pieces.
Figure 31:
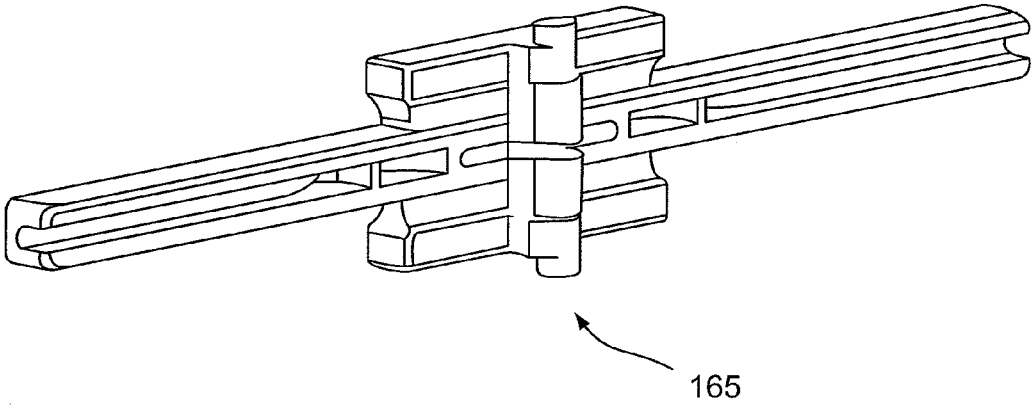
FIG. 31 illustrates a front perspective view of a hinge of the embodiment of FIG. 19.
Figure 32:
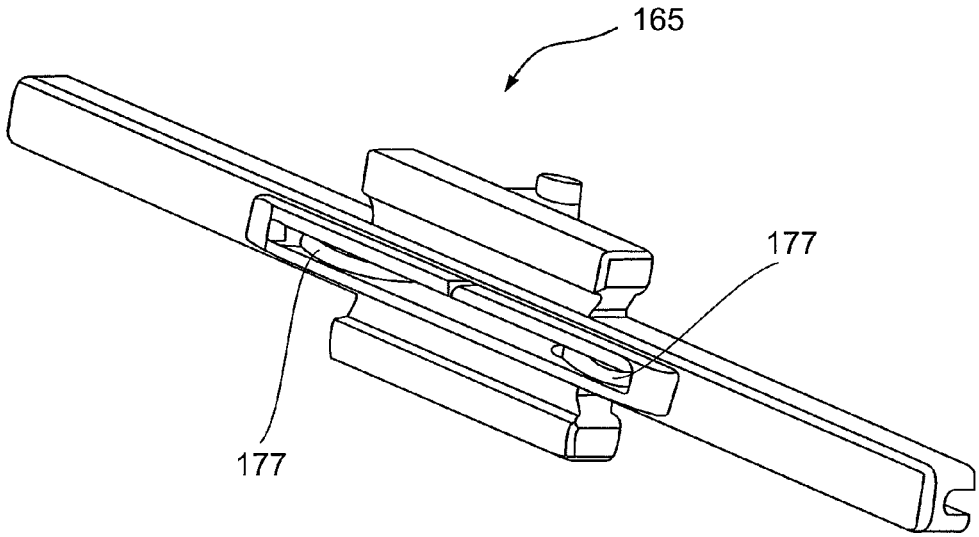
FIG. 32 is a rear perspective view of the hinge shown in FIG. 31.

FIG. 30 shows the components of one embodiment of holding mechanism 170 temporarily removed from writing board 100 for ease of display. For example, holding mechanism 170 may include resilient member 171, right and left cables 172, right and left cable clamps 173, left cable anchor 174 and right cable anchor 175. Cables 172 may be wrapped around left and right cable anchors 174, 175 and secured by cable clamps 173 to form the right and left ends of holding mechanism 170. As shown in FIGS. 30-32, cables 172 may be threaded through cable passages 177 in right and left hinges 165, which permit cables 172 to pass from one side of the hinge to the other side to permit actuation of holding mechanism 170. Cables 172 may then be connected to either end of resilient member 171, as shown in FIG. 30.

Figure 33:
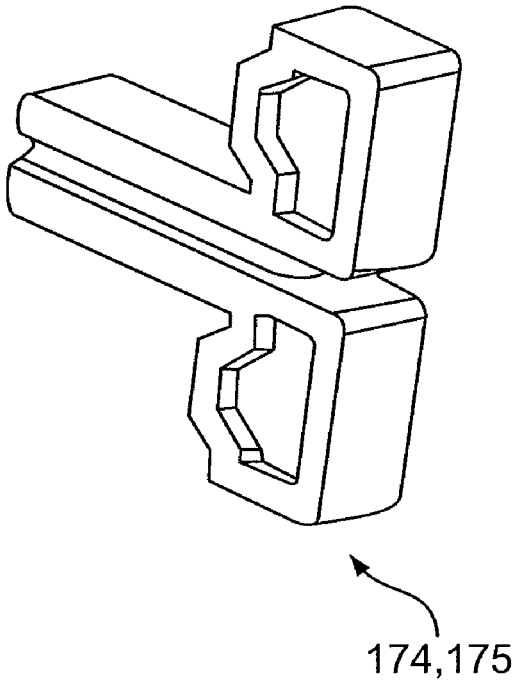
FIG. 33 is a perspective view of an anchor installed in the embodiment of FIG. 19.
Figure 34:
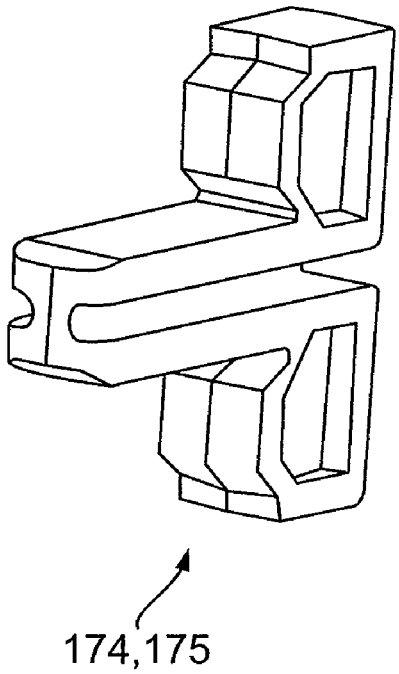
FIG. 34 is another perspective view of the anchor shown in FIG. 33.
Figure 35:
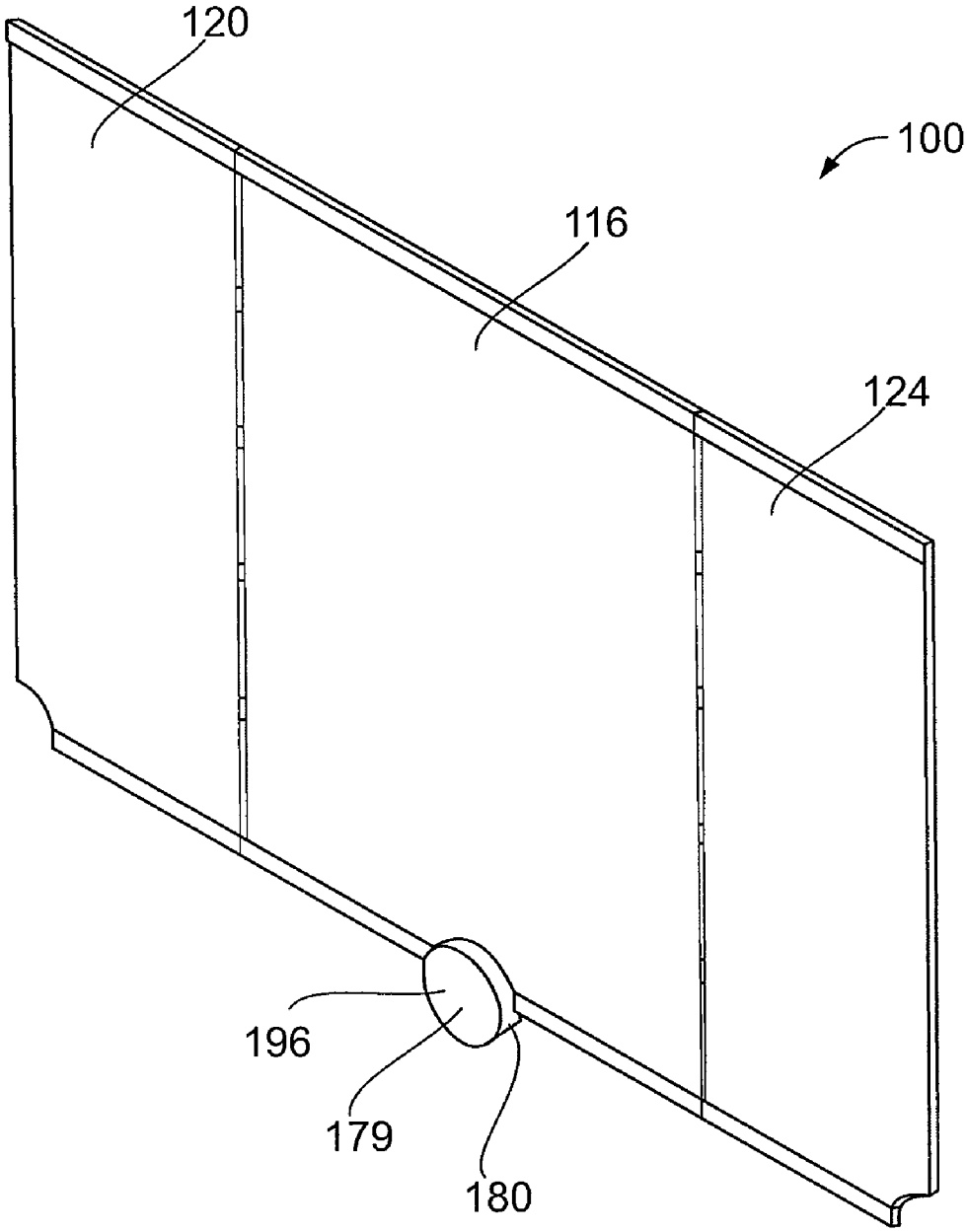
FIG. 35 is a right front perspective view of the embodiment of the invention with both side panels fully open and including a writing instrument holder and eraser holder.
Figure 36:
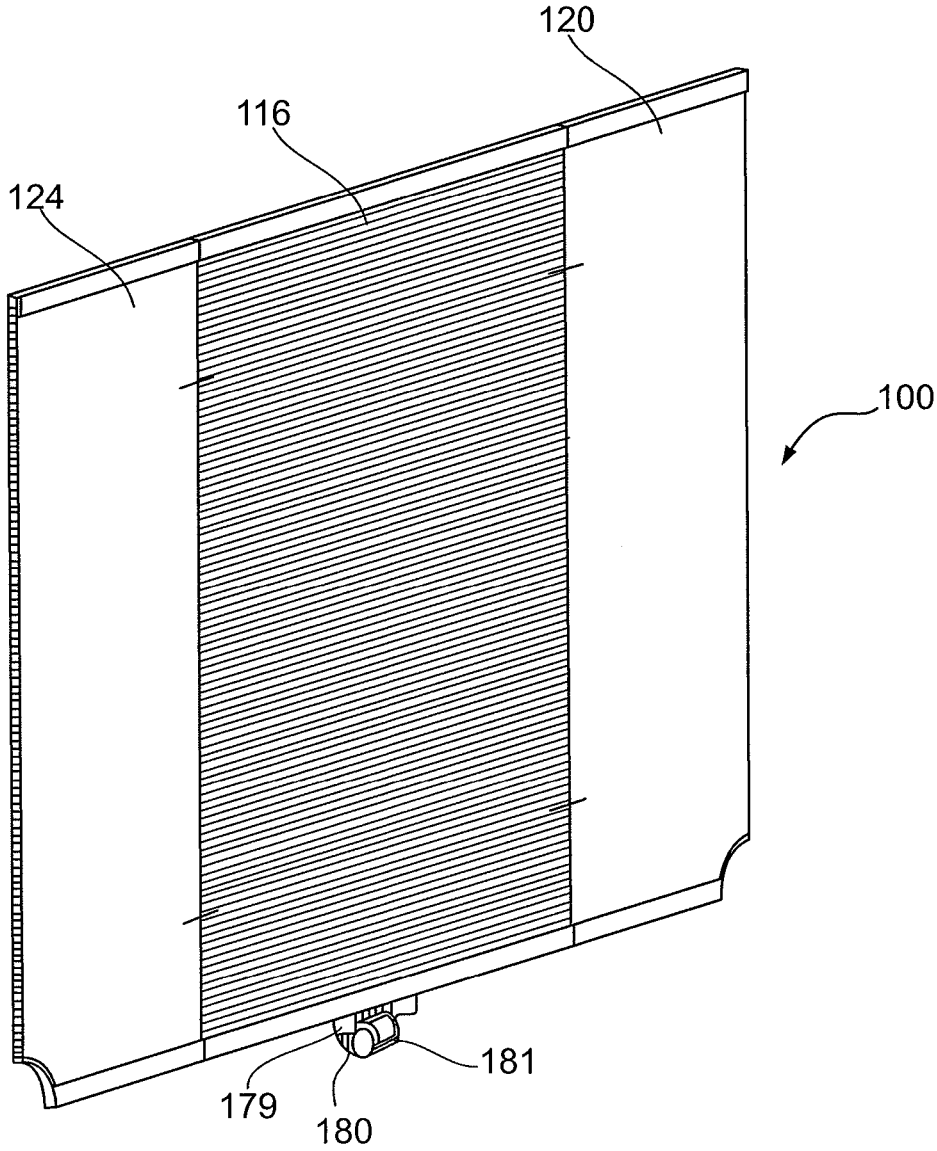
FIG. 36 is right rear perspective view of the embodiment shown in FIG. 35.
Figure 37:
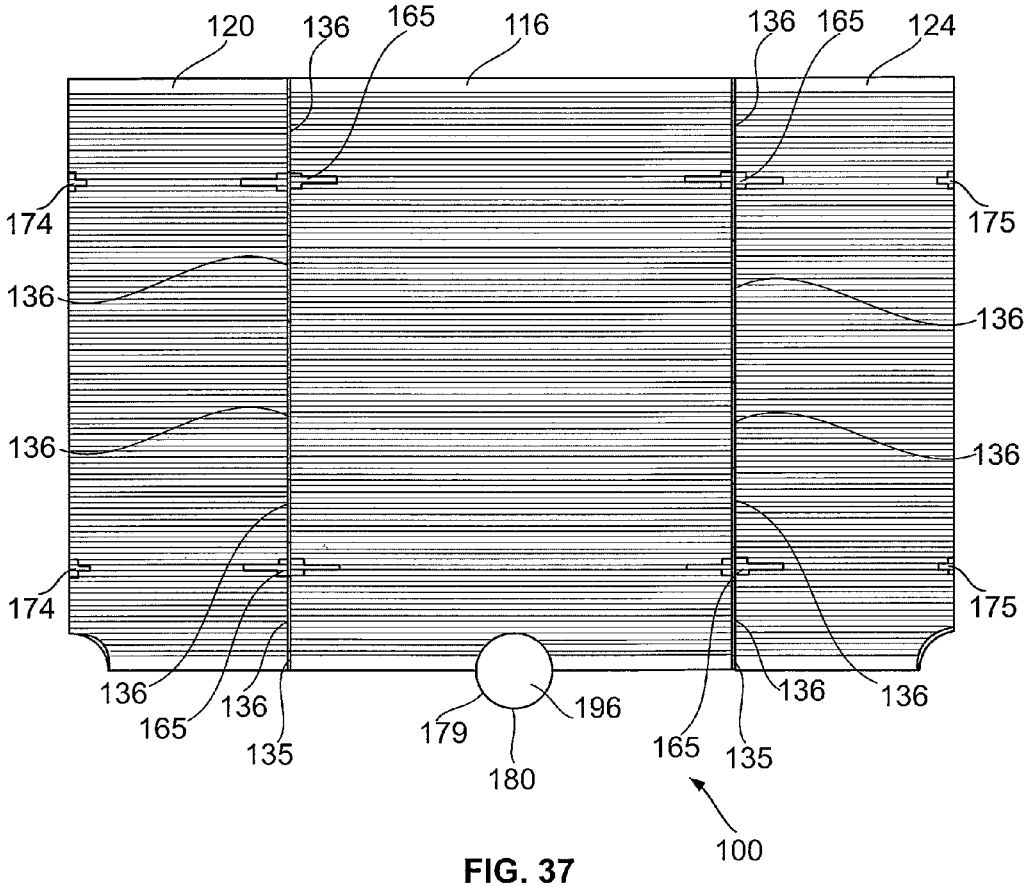
FIG. 37 is a front elevational view of the embodiment of FIG. 35.
Figure 38:
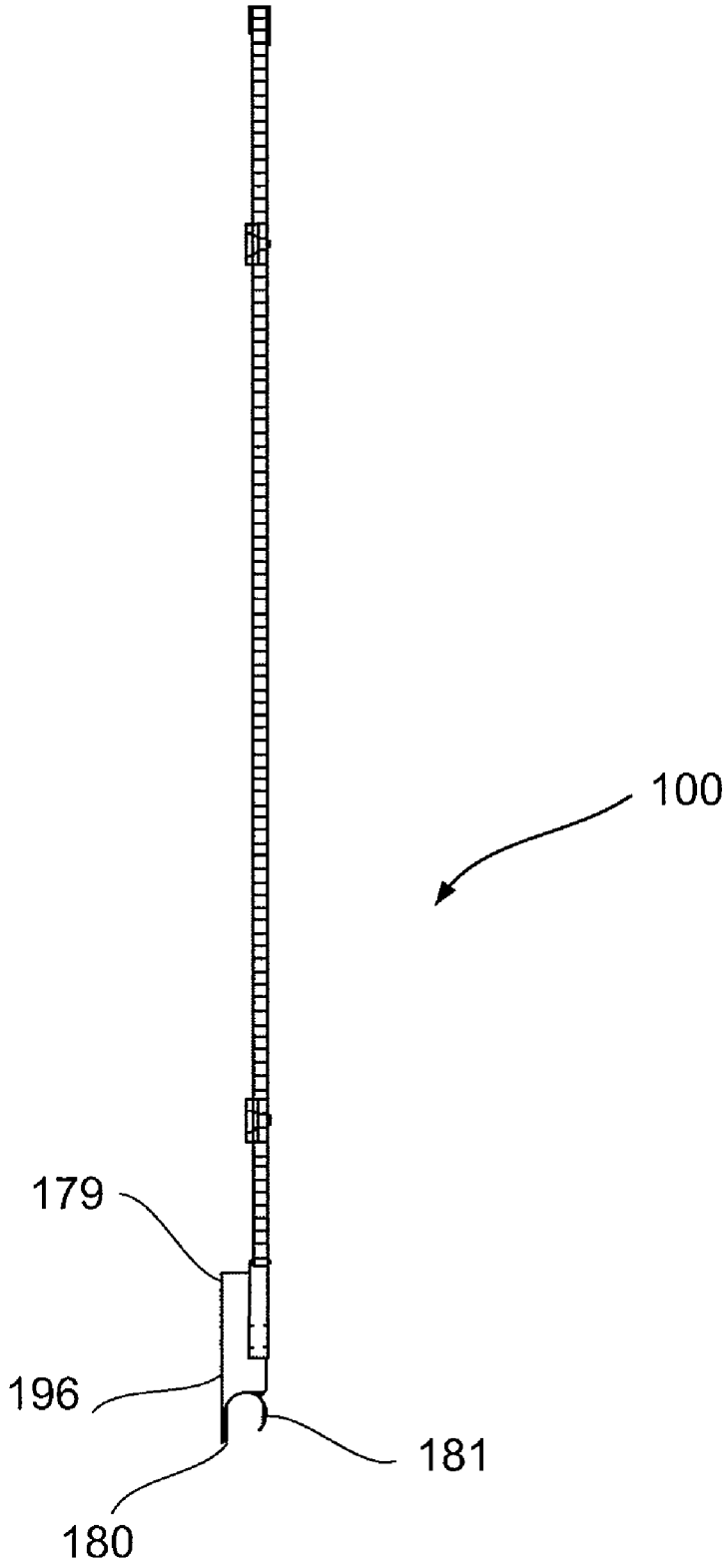
FIG. 38 is a right side elevational view of the embodiment of FIG. 35.
Figure 39:
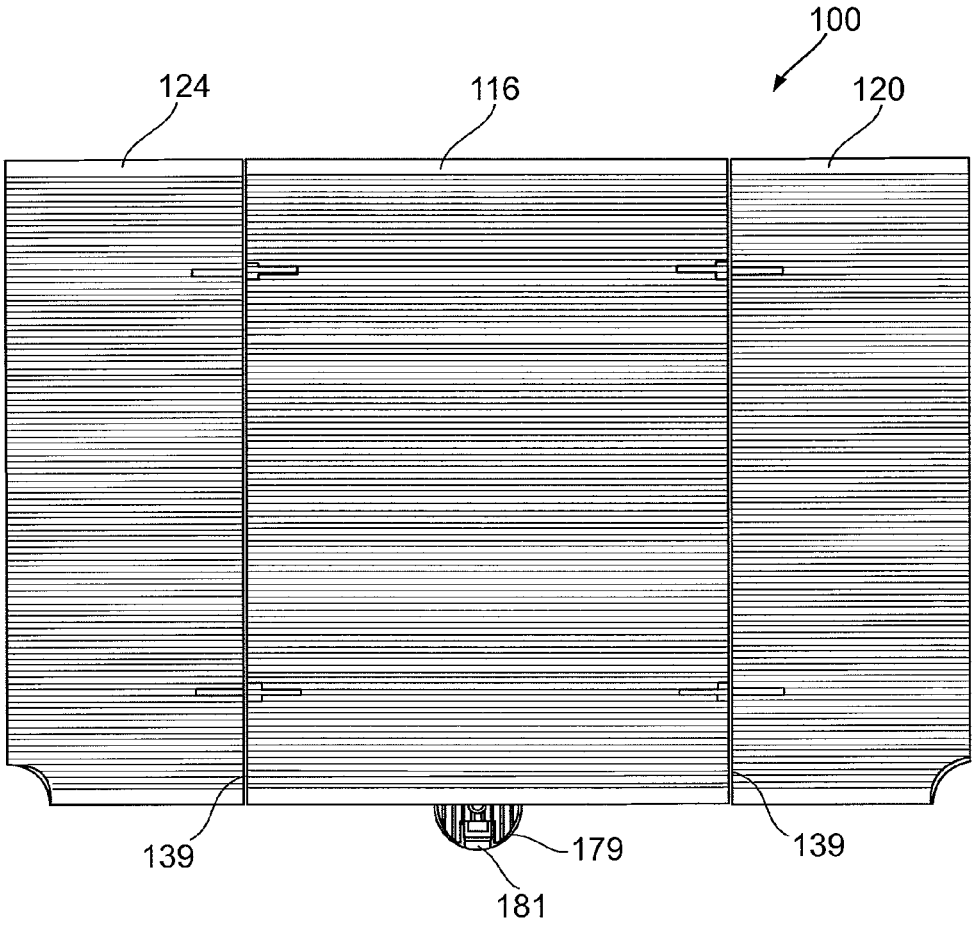
FIG. 39 is a rear elevational view of the embodiment of FIG. 35.
Figure 40:
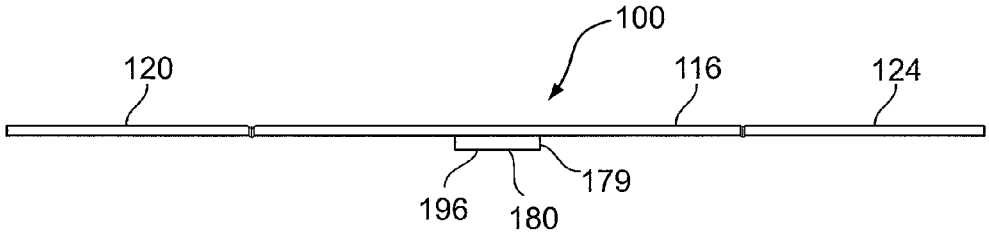
FIG. 40 is a top-plan view of the embodiment of FIG. 35.
Figure 41:
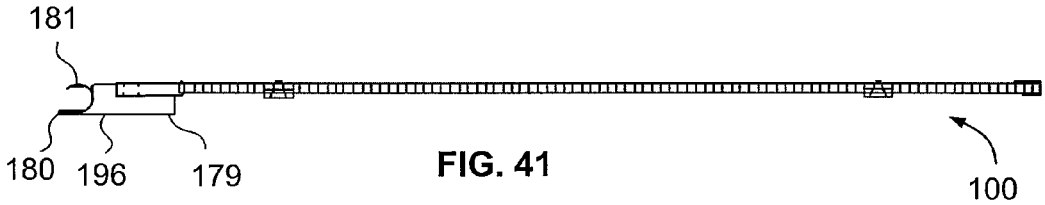
FIG. 41 is a left side elevational view of the embodiment of FIG. 35.
Figure 42:
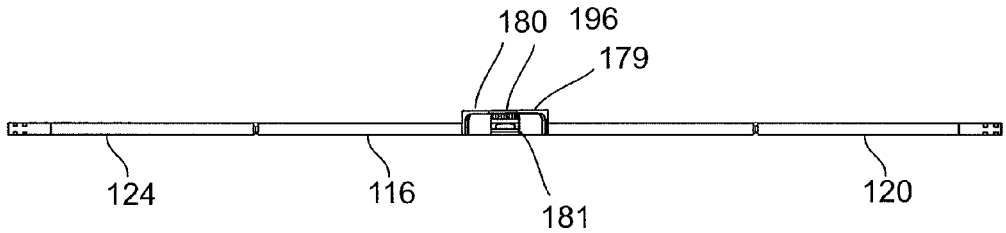
FIG. 42 is a bottom-plan view of the embodiment of FIG. 35.
Figure 43:
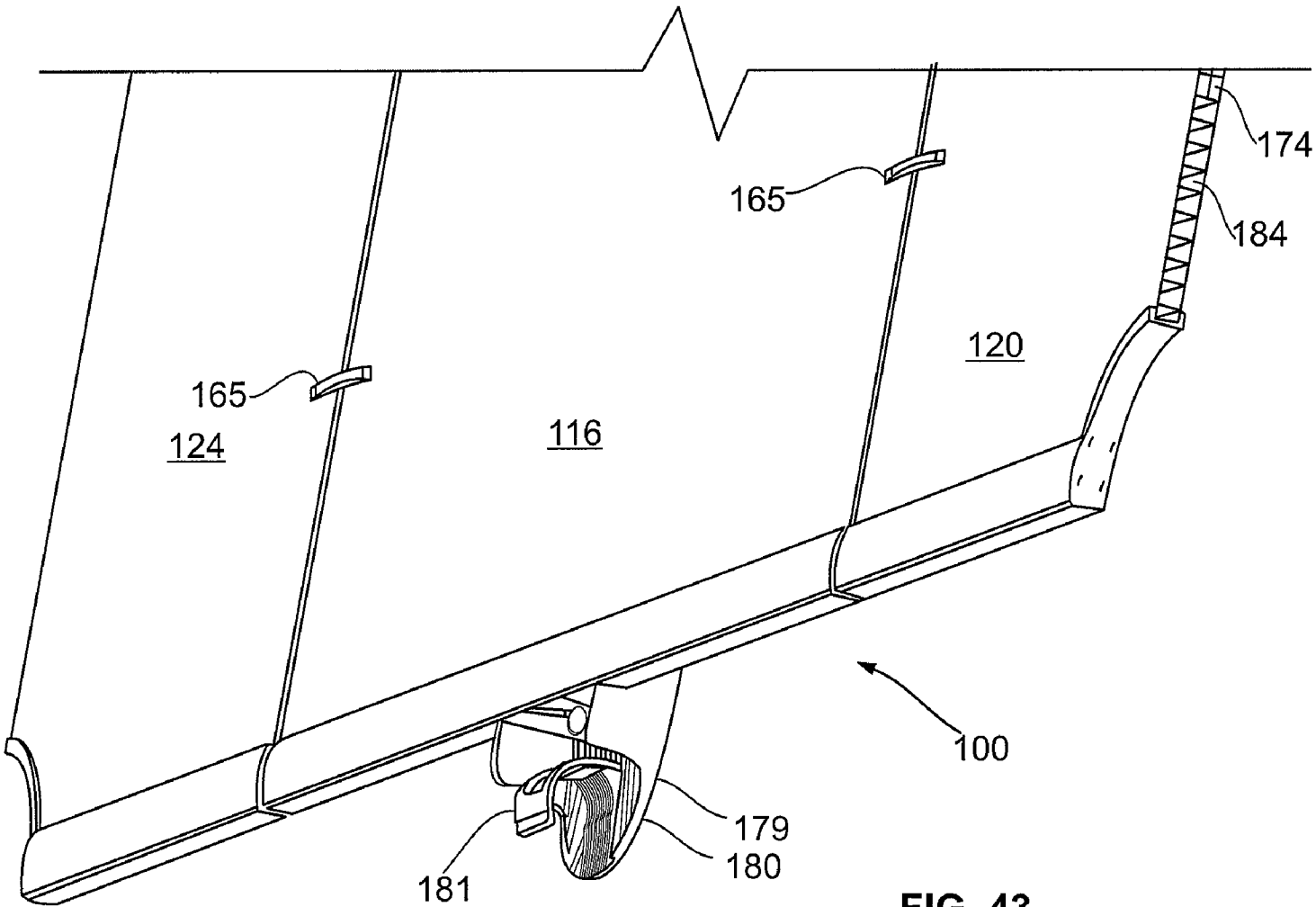
FIG. 43 is a left rear partial view of the embodiment of FIG. 35.

As shown in FIGS. 25-29, various components of holding mechanism 170 may be inserted in one or more flutes 184 (see FIG. 29) of writing board 100 and connected to one another using conventional means. As best shown in FIGS. 31-32, right and left hinges 165 may each include elongated flute mounts on either side of each hinge 165, which may be secured inside respective flutes near either end of backslit 139 by means of an interference fit, as shown in FIGS. 25-28. Similarly, as best shown in FIGS. 33-34, left and right cable anchors 174, 175 may each include elongated flute mounts for insertion into respective flutes 184 on respective ends of side panels 120, 124 (see, e.g., FIG. 29) that correspond with the flutes that house the various components of holding mechanism 170. Moreover, as shown in FIG. 29, left and right cable anchors 174, 175 may be designed to mesh with adjoining ribs 132 to secure cable anchors 174, 175 to side panels 120, 124.

Like writing board 10, as shown in FIG. 25, writing board 100 may also include mount 155 to permit securing or mounting of writing board 100 onto any surface, such as a vertical surface. Mount 155 may comprise, for example, one or more conventional picture hanger mounts or one or more hook and loop strips as may be necessary, depending on the overall size and weight of writing board 100.

FIGS. 35-39 illustrate the embodiment of FIGS. 19-34, but also showing writing instrument holder/eraser organizer 179, which may be fastened to or releasably retained on writing board 100 using conventional means, such as fasteners, interference fits, snap fits, or adhesives. Writing instrument holder/eraser organizer 179 may include writing instrument holder 180 comprising, for example, clip 181 for resiliently holding writing instrument 82 through a conformal receptacle on holder 180 having an interference fit with writing instrument 82, and eraser attachment surface 196 for attaching an eraser, such as eraser 90 shown in FIGS. 12*a-c* and 13. Eraser attachment surface 196 may include a magnet, hook and loop fastener means, or any other releasable fastening means for releasably securing eraser 90 to writing instrument holder/eraser organizer 179. Writing instrument holder/eraser organizer 179 may be configured to hold one or more writing instruments 82.

While specific embodiments of the invention have been described in detail, it will be appreciated by those skilled in the art that various modifications and alternatives to those details could be developed in light of the overall teachings of the disclosure. Accordingly, the particular method disclosed is meant to be illustrative only and not limiting as to the scope of the invention which is to be given the full breadth of the appended claims and any equivalents thereof.

What is claimed is:

1. A writing board, comprising:

a substrate, comprising a front panel, a rear panel opposite the front panel, and a plurality of spaced apart ribs connecting the front panel to the rear panel, wherein the front panel and the rear panel are integrally formed with the plurality of ribs;

at least one backslit formed in the rear panel;

at least one living hinge formed in the front panel opposite the at least one backslit to form at least one outer panel; and at least one holding mechanism coupled to the at least one outer panel to maintain the outer panel in one of a substantially open, unfolded position or a substantially closed, folded position.

2. The writing board of claim 1, wherein the plurality of ribs are oriented in a widthwise direction, a lengthwise direction, both a widthwise direction and a lengthwise direction, or a diagonal direction of the substrate.

3. The writing board of claim 2, wherein each of the plurality of ribs continuously extend in the lengthwise direction or the widthwise direction from a first end of the substrate to a second end of the substrate opposite the first end to form a plurality of cavities that each extend from the first end to the second end.

4. The writing board of claim 1, further including a film affixed to at least one of the front or rear panels of the substrate, the film having a surface adapted to erasably receive writing thereon.

5. The writing board of claim 4, wherein the film is a polyester, a UV cured polyurethane, or a polypropylene.

6. The writing board of claim 1, wherein the at least one holding mechanism comprises a resilient member, at least one cable connected to at least one end of the resilient member, and at least one anchor connected to the at least one cable and to the at least one outer panel.

7. The writing board of claim 6, wherein the at least one holding mechanism is housed in at least one trim panel removably affixed to a peripheral edge of the substrate.

8. The writing board of claim 6, wherein a portion of the at least one holding mechanism is housed in at least one flute formed between two adjacent ribs, the front panel, and the rear panel of the substrate.

9. The writing board of claim 8, wherein the at least one holding mechanism further comprises at least one hinge comprising a plurality of flute mounts, wherein the flute mounts are mounted inside the at least one flute on respective sides of the at least one backslit to secure the at least one hinge to the substrate and to permit articulation of the at least one outer panel.

10. The writing board of claim 1, wherein the at least one holding mechanism exerts a force to the at least one outer panel that varies during articulation of the at least one outer panel.

11. The writing board of claim 10, wherein the force increases from a first minimum when the at least one outer panel is in the substantially open, unfolded position to a maximum when the at least one outer panel is in a partially articulated position, then decreases to a second minimum when the at least one outer panel is in the substantially closed, folded position, each of the at least one holding mechanism being in tension when the at least one outer panel is in the substantially open, unfolded position and in the substantially closed, folded position to create a tendency for maintaining the outer panel in the substantially open, unfolded position and the substantially closed, folded position.

12. The writing board of claim 1, further including a writing instrument holder affixed to the substrate, comprising an eraser mount for detachably receiving an eraser, and at least one clip for detachably receiving at least one writing instrument, wherein the at least one outer panel is configured to avoid interference with the writing instrument holder when the at least one outer panel is articulated to and from the substantially closed, folded position.

13. A writing board, comprising:

a substrate comprising a front panel and a rear panel separated by a spacer, wherein the front panel and the rear panel are integrally formed with the spacer;

at least one backslit formed in the rear panel;

at least one living hinge formed in the front panel opposite the at least one backslit to form at least one outer panel; and at least one holding mechanism operable to maintain the outer panel in one of a substantially open, unfolded position or a substantially closed, folded position.

14. The writing board of claim 13, further including a film affixed to at least one of the front or rear panels of the substrate, the film having a surface adapted to erasably receive writing thereon.

15. The writing board of claim 13, wherein the substrate comprises one of corrugated paper, a foam, a metal, or a plastic.

16. The writing board of claim 13, wherein the spacer is formed as a solid, a porous solid, a plurality of spaced apart ribs, a plurality of honeycomb cells, or a plurality of corrugations.

17. The writing board of claim 13, wherein the at least one holding mechanism is housed in at least one trim panel removably affixed to a peripheral edge of the substrate.

18. The writing board of claim 17, wherein the at least one holding mechanism exerts a force to the at least one outer panel that increases from a first minimum when the at least one outer panel is in the substantially open, unfolded position to a maximum when the at least one outer panel is in a partially articulated position, then decreases to a second minimum when the at least one outer panel is in the substantially closed, folded position, each of the at least one holding mechanism being in tension when the at least one outer panel is in the substantially open, unfolded position and in the substantially closed, folded position to create a tendency for maintaining the outer panel in the substantially open, unfolded position and the substantially closed, folded position.

19. A writing board comprising:

a substrate having a front panel connected to a rear panel by a plurality of ribs, wherein at least one of the front or rear panels comprises a dry erase property; and a plurality of outer panels formed in the substrate, the plurality of outer panels configured to articulate from a substantially open, unfolded position to a substantially closed position and from the substantially closed position to the substantially open, unfolded position, wherein the plurality of outer panels are maintainable in the substantially open, unfolded position or the substantially closed, folded position by a plurality of holding mechanisms coupled to the plurality of outer panels, wherein a first end of each of the plurality of holding mechanisms is anchored to one of the plurality of outer panels, and a second end of each of the plurality of holding mechanisms is anchored to another of the plurality of outer panels, wherein each of the plurality of holding mechanisms is in tension when the at least one outer panel is in the substantially open, unfolded position and in the substantially closed, folded position to create a tendency for maintaining the outer panel in the substantially open, unfolded position and the substantially closed, folded position.

20. The writing board of claim 19, wherein each of the plurality of holding mechanisms exerts a force upon the plurality of outer panels that initially increases when any one of the plurality of outer panels is articulated from a substantially open, unfolded position or a substantially closed, folded position, then decreases when any one of the plurality of outer panels is articulated past a stationary point of inflection.

21. The writing board of claim 19, further including a writing instrument holder affixed to the substrate, comprising an eraser mount for detachably receiving an eraser, and at least one clip for detachably receiving at least one writing instrument, wherein the at least one outer panel is configured to avoid interference with the writing instrument holder when the at least one outer panel is articulated to and from the substantially closed, folded position.

22. The writing board of claim 19, further comprising a mount affixed to the rear panel of the substrate to permit detachable affixation of the writing board to a surface.

23. The writing board of claim 19, further comprising a plurality of backslits formed in the rear panel to permit the plurality of outer panels to articulate.

24. The writing board of claim 23, further comprising a plurality of living hinges formed in the front panel opposite the plurality of backslits.

* * * * *